US006843548B2

(12) United States Patent
Arakawa et al.

(10) Patent No.: US 6,843,548 B2
(45) Date of Patent: Jan. 18, 2005

(54) INK-JET PRINTER

(75) Inventors: Hiroaki Arakawa, Uenohara-machi (JP); Yasuhiro Matsui, Tokyo (JP)

(73) Assignee: Konica Corporation, Tokyo (JP)

( * ) Notice: Subject to any disclaimer, the term of this patent is extended or adjusted under 35 U.S.C. 154(b) by 23 days.

(21) Appl. No.: 10/336,989

(22) Filed: Jan. 6, 2003

(65) Prior Publication Data

US 2003/0132981 A1 Jul. 17, 2003

(30) Foreign Application Priority Data

Jan. 11, 2002 (JP) ..... P2002-004708
May 10, 2002 (JP) ..... P2002-136228
Aug. 9, 2002 (JP) ..... P2002-233053

(51) Int. Cl.[7] ..... B41J 29/393; B41J 29/38
(52) U.S. Cl. ..... 347/19; 347/14
(58) Field of Search ..... 347/14, 19

(56) References Cited

U.S. PATENT DOCUMENTS 5,517,216 A * 5/1996 Stamer et al. ..... 347/6
6,568,780 B2 * 5/2003 Schantz et al. ..... 347/14
2002/0070993 A1 * 6/2002 Mantell ..... 347/19
2003/0048331 A1 * 3/2003 Takahashi et al. ..... 347/57

FOREIGN PATENT DOCUMENTS

JP 11-300944 A 11/1999

* cited by examiner

*Primary Examiner*—Stephen D. Meier
*Assistant Examiner*—Alfred Dudding
(74) *Attorney, Agent, or Firm*—Frishauf, Holtz, Goodman & Chick, P.C.

(57) ABSTRACT

There is described an ink-jet printer, which emits ink particles onto a recording medium to prints an image on the recording medium, and in which moving velocities of the ink particles are detected to perform stable emitting actions of the ink particles. The ink-jet printer includes: an ink-jetting head having a plurality of nozzles from which the ink particles are emitted; a velocity detecting section to detect moving velocities of the ink particles by measuring detection times at each of which each of the ink particles is detected; a calculating section to calculate an average value of the detection times measured by the velocity detecting section; and a head-drive controlling section that compares the average value calculated by the calculating section with a target value established in advance, to change a driving condition for the ink-jetting head so that the average value coincides with the target value.

20 Claims, 19 Drawing Sheets

INK-JET PRINTER

BACKGROUND OF THE INVENTION

The present invention relates to an ink-jet printer, which emits ink particles onto a recording medium to prints an image on the recording medium, and specifically relates to an ink-jet printer, in which moving velocities of the ink particles, being micro droplets of ink, are detected to perform stable emitting actions of the ink particles.

In recent years, a great number of image printing methods using an ink-jet printer have been employed as convenient methods for forming images at a reduced cost. The ink-jet printer prints images onto paper or other recording media by emitting ink as ink particles from a plurality of emission ports towards the recording media by use of a voltage applied to a piezoelectric element or heater provided on the ink-jetting head of the printer, and then scanning the recording media with the ink-jetting head while fixing the ink onto the recording media.

However, to print images on recording media with stable accuracy, ink particles emitted from the emission ports of each nozzle are required to hit the recording media at properly timed intervals according to the particular operation of the ink-jetting head. It is preferable, therefore, that the emission velocity of ink from each nozzle of the ink-jetting head should be kept constant.

According to the prior art practice, however, the velocity of ink particles emitted may vary according to each emission port if the status of the emission ports deteriorates due to drying of the ink or the ingress of dirt, air bubbles or the like.

Further, a plurality of ink-jetting heads are used to implement color printing according to the prior art. In this case, however, the velocity of the ink particles emitted may also differ depending on the ink-jetting heads because of idiosyncrasies of each recording head and the type of ink used in each ink-jetting head.

If the velocity of the ink particles emitted differs depending on according to each emission port of the ink-jetting head or each ink-jetting head, image-printing accuracy may deteriorated, as described above.

For example, if the emission velocity of ink particles changes at some emission ports, the status of the emission ports may have been deteriorated, as described above. If this trouble is left unprepared, ink may not be emitted from some of the nozzles.

Further, the ink-jet recorder emits ink particles in the form of minute liquid droplets from a multitude of nozzles formed on the ink-jetting head so that they will hit the recording media arranged so as to face the nozzle surfaces of the ink-jetting head. Then a desired image is recorded and formed on the recording media during main scanning of the ink-jetting head in both directions.

To achieve high-quality image recording with such an ink-jet recorder, it is necessary to keep track of how the ink particles are emitted from each nozzle of the ink-jetting head. If the ink particles emitted from each nozzle of the ink-jetting head are kept in a constant status, there will be deviations in the position of ink particles reaching the recording media during main scanning of the recording media in both directions by the ink-jetting head. For example, if the velocity of ink particles emitted from each nozzle of the ink-jetting head is lower than the intended velocity, the ink particle "a" that should hit a target line X on the recording media reaches a position deviated from the target line X by the distance corresponding to the lower velocity, as shown in FIG. 18. This is repeated for each main-scanning operation of the ink-jetting head in both directions (indicated by the arrow). Deviations in the position hit by ink particles in both directions will cause disturbances in the image recorded, thus reducing resolution significantly.

Since changes in the velocity of ink particles appear as changes in the amount of particles, the density of the recorded image will change, and the color balance of the image will also be changed.

Further, when the stable driving conditions for ink particle emission of the ink-jetting head are not met, air will be entrapped into the ink chamber to prevent ink particles from being emitted correctly, or ink particles will take a curved course, resulting in stripe-like irregularities. This will cause image quality to deteriorate significantly.

When the ink-jetting head consists of a plurality of ink-jetting heads that records images using ink of different colors such as yellow (Y), magenta (M), cyan (C), and black (K), the position hit by ink particles varies from color to color due to the difference in the distance between the recording medium of each ink-jetting head and the head surface.

The prior art of detecting the velocities of the minute ink particles emitted from the ink-jetting head, and modifying and controlling the ink-jetting head driving conditions based on the detection is disclosed in the Official Gazette of Japanese Application Patent Laid-Open Publication No. Hei 11-300944. According to this prior art, however, the velocities of the particles emitted from the multiple nozzles formed on the ink-jetting heads are detected for each nozzle. To detect the velocities of the particles emitted from all nozzles, more time is required. Namely, each ink-jetting head must be stopped to ensure that ink particles emitted from each nozzle of the ink-jetting head will match the detection position (an optical path of detecting beam or detecting range) of velocity detection means. This requires a very high positioning accuracy when the ink-jetting head is positioned at the detection position. Thus, a lot of time must be consumed in the control of stop position, hence velocity detection, according to the aforementioned prior art. Especially when the recording mechanism has a plurality of ink-jetting heads for ink of different colors, a great deal of time is required since each ink-jetting head must be stopped to detect velocities.

SUMMARY OF THE INVENTION

To overcome the abovementioned drawbacks in conventional ink-jet printers, it is a first object of the present invention to provide an ink-jet printer that can print images with stable accuracy.

Further, it is a second object of the present invention to minimize the causes of image deterioration and to ensure high-quality image recording, by keeping track of the velocities of the ink particles emitted from ink-jetting heads and modifying the driving conditions of the ink-jetting heads based on the aforementioned velocities.

Still further, it is a third object of the present invention to provide an ink-jet printer that is capable of quick measurement of the moving velocities of ink particles through detection of the velocities of ink particles emitted from the nozzles during the moving process, without having to stop each of the ink-jetting heads at a predetermined detection position as in the prior art, and capable of compensating for changes in the moving velocities of ink due to environmental changes or due to rise in the temperatures of the ink-jetting heads based on measurement results.

Accordingly, to overcome the cited shortcomings, the abovementioned objects of the present invention can be attained by ink-jet printers described as follow.

(1) An ink-jet printer, comprising: an ink-jetting head having a plurality of nozzles from which ink particles, being microscopic droplets of ink, are emitted; a velocity detecting section to detect moving velocities of the ink particles, each of which is emitted from each of the plurality of nozzles, by measuring detection times at each of which each of the ink particles is detected; a calculating section to calculate an average value of the detection times measured by the velocity detecting section; and a head-drive controlling section that compares the average value calculated by the calculating section with a target value established in advance, to change a driving condition for the ink-jetting head so that the average value coincides with the target value.

(2) The ink-jet printer of item 1, further comprising: a target-value changing section to change the target value corresponding to an environmental condition around the ink-jet printer.

(3) The ink-jet printer of item 1, wherein the head-drive controlling section determines the driving condition, based on a difference value between the target value and the average value calculated by the calculating section.

(4) The ink-jet printer of item 1, wherein the head-drive controlling section determines the driving condition, by employing a look-up table based on a difference value between the target value and the average value calculated by the calculating section.

(5) The ink-jet printer of item 1, wherein, when the driving condition, determined by the head-drive controlling section, deviates from a stably-emitting condition of the ink particles, the head-drive controlling section establishes a specific value as the driving condition, the specific value being approximately equal to a marginal value for a stably-emitting action of the ink-jetting head.

(6) The ink-jet printer of item 1, further comprising: a determining section to determine whether or not each of the detection times measured by the velocity detecting section exceeds a predetermined time value; wherein, when the determining section determines that a detection time of a specific nozzle exceeds the predetermined time value, the calculating section excludes the detection time of the specific nozzle from a group of detection times objective for calculating the average value.

(7) The ink-jet printer of item 1, wherein the ink-jet printer comprises a plurality of ink-jetting heads, each of which corresponds to the ink-jetting head, and the target value is established for each of the plurality of ink-jetting heads (8) An ink-jet printer, comprising: an ink-jetting head having a plurality of nozzles from which ink particles, being microscopic droplets of ink, are emitted; a velocity detecting section to detect moving velocities of the ink particles, each of which is emitted from each of the plurality of nozzles, by measuring detection times at each of which each of the ink particles is detected; a moving device to move the ink-jetting head and/or the velocity detecting section relative to each other; an emitting-action controlling section to control the ink-jetting head so that an action for emitting at least one of the ink particles from at least one of predetermined plural nozzles, included among all of the plurality of nozzles, is conducted at a timing when the plurality of nozzles cross a detectable region of the velocity detecting section in a relative moving process of the ink-jetting head and the velocity detecting section; and a head-drive controlling section that compares a detected value detected by the velocity detecting section with a target value established in advance, to change a driving condition for the ink-jetting head so that the detected value coincides with the target value.

(9) The ink-jet printer of item 8, wherein the emitting-action controlling section controls the ink-jetting head so that the action for emitting at least one of the ink particles from at least one of the predetermined plural nozzles, included among all of the plurality of nozzles, is repeated plural times at the timing when the plurality of nozzles cross the detectable region of the velocity detecting section; and wherein the detected value to be compared with the target value is an average value of plural detected values, each of which is detected every time of the plural times by the velocity detecting section.

(10) The ink-jet printer of item 8, further comprising: a target-value changing section to change the target value corresponding to an environmental condition around the ink-jet printer.

(11) The ink-jet printer of item 8, wherein the head-drive controlling section determines the driving condition, based on a difference value between the target value and detected value detected by the velocity detecting section.

(12) The ink-jet printer of item 8, wherein the head-drive controlling section determines the driving condition, by employing a look-up table based on a difference value between the target value and the detected value detected by the velocity detecting section.

(13) The ink-jet printer of item 8, wherein, when the driving condition, determined by the head-drive controlling section, deviates from a stably-emitting condition of the ink particles, the head-drive controlling section establishes a specific value as the driving condition, the specific value being approximately equal to a marginal value for a stably-emitting action of the ink-jetting head.

(14) The ink-jet printer of item 8, wherein the ink-jet printer comprises a plurality of ink-jetting heads, each of which corresponds to the ink-jetting head, and the target value is established for each of the plurality of ink-jetting heads.

(15) An ink-jet printer, which prints an image on a recording medium by emitting ink particles onto the recording medium, comprising: an ink-jetting head to emit the ink particles from a plurality of nozzles onto the recording medium; and a velocity measuring section to measure moving velocity values of the ink particles emitted from the plurality of nozzles; wherein a nozzle average value, being an average value of the moving velocity values measured by the velocity measuring section, is calculated, and a specific nozzle, which emits an ink particle at a moving velocity value being different from the nozzle average value by more than a predetermined value, is detected.

(16) The ink-jet printer of item 15, wherein, when the specific nozzle is detected, a maintenance operation for normalizing the specific nozzle is executed.

(17) An ink-jet printer, which prints an image on a recording medium by emitting ink particles onto the recording medium, comprising: a plurality of ink-jetting heads, each of which emits the ink particles from a plurality of nozzles onto the recording medium in response to drive-voltages applied to the plurality of nozzles; and a velocity measuring section to measure moving velocity values of the ink particles emitted from the plurality of nozzles; wherein nozzle average values, each of which is an average value of the moving velocity measured for each of the plurality of ink-jetting heads by the velocity measuring section, are calculated, and then, a head average value, being an average value of the nozzle average values, is calculated; and wherein, with respect to a specific ink-jetting head, a nozzle average value of which is different from the head average value by more than a predetermined value, the drive-voltages, to be applied to the plurality of nozzles of the specific ink-jetting head, are compensated for.

(18) The ink-jetting head of item 17, further comprising: a head-drive controlling section to control the plurality of ink-jetting heads; and a head-driving circuit to apply the drive-voltages to the plurality of nozzles, based on control signals transmitted from the head-drive controlling section; wherein the velocity measuring section includes an ink-particle detecting device, disposed at a predetermined position being apart from the plurality of nozzles to detect passages of the ink particles, and a time-measuring circuit to measure time differences between output timings of the control signals and detected timings of the passages of the ink particles; and wherein the moving velocity values of the ink particles emitted from the plurality of nozzles are equivalent to the time differences.

(19) An ink-jet printer, which prints an image on a recording medium by emitting ink particles onto the recording medium, comprising: a plurality of ink-jetting heads, each of which emits the ink particles from a plurality of nozzles onto the recording medium; a velocity measuring section to measure moving velocity values of the ink particles emitted from the plurality of nozzles; a head-drive controlling section to control the plurality of ink-jetting heads; and a head-driving circuit to drive the plurality of ink-jetting heads so as to emit the ink particles from the plurality of nozzles, based on control signals transmitted from the head-drive controlling section; wherein the velocity measuring section includes an ink-particle detecting device, disposed at a predetermined position being apart from the plurality of nozzles to detect passages of the ink particles, and a time-measuring circuit to measure time differences between output timings of the control signals and detected timings of the passages of the ink particles; and wherein the moving velocity values of the ink particles emitted from the plurality of nozzles are equivalent to the time differences.

(20) The ink-jet printer of item 19, wherein the ink-particle detecting device includes a wave-receiving section to receive a wave motion; and wherein the velocity measuring section detects a passage of an ink particle, based on either a local maximum or a local minimum of an output value of the wave-receiving section, which varies associating with an action of shading the wave motion to be arrived at the wave-receiving section.

Further, to overcome the abovementioned problems, other ink-jet printers, embodied in the present invention, will be described as follow:

(21) An ink-jet printer that prints images by emitting ink onto recording media, characterized by comprising;

an ink-jetting head for emitting ink as particles from a plurality of nozzles onto a recording medium, and velocity measuring means for measuring the values for the velocity of the ink emitted from the aforementioned nozzles;

the aforementioned ink-jet printer being further characterized in that the velocity measuring means measures the values for the velocity of the ink emitted from each nozzle, calculates the average nozzle value as the average value for these velocities, and detects the nozzle that emits ink particles at a velocity differing from the aforementioned average nozzle value by more than a predetermined value.

The velocity of the ink emitted from each nozzle of the ink-jetting head is compared with the average nozzle value for all nozzle emission velocities, whereby the nozzle that causes image printing accuracy to be deteriorated by timing error of the ink hitting the recording medium is detected as a nozzle where the velocity of the emitted ink is lower or higher than that of other nozzles.

(22) An ink-jet printer according to Item (21) further characterized in that, when a nozzle has been detected that emits ink particles at the velocity differing from the aforementioned average nozzle value by more than the predetermined value, maintenance is performed on the ink-jetting head of the detected nozzle.

When the nozzle has been detected that causes the image printing accuracy to deteriorate, maintenance is carried out on the ink-jetting head provided with that nozzle. Cleaning operation such as ink absorption is carried out to remove clogging or other troubles from that nozzle. This step ensures that ink particles emitted from each nozzle always hit the recording medium at the same timed intervals. It allows the ink-jetting head to print images with stable accuracy at all times, and makes it possible to provide an ink-jet printer capable of printing images with more stabilized accuracy (23) An ink-jet printer that prints images by emitting ink onto recording media, characterized by comprising;

a plurality of ink-jetting heads for emitting ink as ink particles from a plurality of nozzles onto a recording medium by applying a voltage, and velocity measuring means for measuring the values for the velocity of the ink emitted from the aforementioned nozzles, and characterized in that, the average nozzle value is calculated as the average value for the velocities of ink particles emitted from the nozzle for each of the aforementioned ink-jetting heads, and the average head value is to calculated as the average of the average nozzle values of each of the aforementioned ink-jetting heads, and then, the applied voltage for the aforementioned ink-jetting head, where the aforementioned average nozzle value differs from the average head value by more than a predetermined value, is corrected.

The average head value as an average of the values for velocities of ink particles emitted from the nozzles equipped in the ink-jetting heads is calculated, and this average head value is compared with the average nozzle value of each ink-jetting head, thereby detecting a ink-jetting head where the velocity of ink particles significantly differs from those of other ink-jetting heads. The voltage to be applied to the ink-jetting heads detected in this manner is corrected, and the value denoting the velocity of ink particles is matched with the values of other ink-jetting heads. This ensures that ink particles emitted from each nozzle always hit the recording medium at the same timed intervals. This removes the factors that cause deterioration in image printing accuracy, with the result that it is possible to provide an ink-jet printer capable of printing images with more stabilized accuracy.

(24) An ink-jet printer according to any one of Items (21), (22) and (23) characterized by further comprising;

controlling means for controlling the aforementioned ink-jetting head, and an ink-jetting head driving circuit for emitting ink from the aforementioned nozzles in accordance with the control signals sent from the aforementioned controlling means; and characterized in that, the aforementioned velocity measuring means further comprises;

an ink particle detector for detecting the passage of ink particles at a predetermined position away from the aforementioned nozzles, and a time counting circuit for measuring the difference in time between the output of the aforementioned control signal and the detection of the ink particles by the aforementioned ink particles detector;

wherein the value for the aforementioned velocity is within the aforementioned time difference.

The value representing the velocity of the ink particles emitted from the nozzle is calculated from the difference in time between the output of the control signal for emitting ink particles from the nozzle, and the detection of the ink particles by the aforementioned ink particle detector. This ensures easy creation of velocity measuring means that detects the value for the velocity of ink particles with sufficient accuracy for comparison between a plurality of nozzles. This makes it possible to create an ink-jet printer capable of printing images with stable accuracy at a low cost.

(25) An ink-jet printer that prints images by emitting ink onto recording media, characterized by comprising;

an ink-jetting head for emitting ink as in particles from a plurality of nozzles onto a recording medium, velocity measuring means for measuring the velocity of the ink particles emitted from the aforementioned nozzles, controlling means for controlling the aforementioned ink-jetting head, and an ink-jetting head driving circuit for emitting ink from the aforementioned nozzles in accordance with the control signals sent from the aforementioned controlling means; and characterized in that, the aforementioned velocity measuring means further comprises a ink particle detector for detecting the passage of ink particles at a predetermined position away from the aforementioned nozzles, and a time counting circuit for measuring the difference in time between the output of the aforementioned control signals and the detection of the ink particles by the aforementioned ink particle detector; the value for the aforementioned velocity being within the aforementioned time difference.

An effect similar to that described in Item (24) can be yielded.

(26) An ink-jet printer according to Item (24) or (25), characterized in that, the aforementioned ink-jet printer further comprises a wave receiver for receiving incident waves, and the aforementioned velocity measuring means detects the passage of the ink particles by determining whether the output of the aforementioned wave receiver that is changed according to the interception of the wave entering the wave receiver takes the maximum or minimum value.

The ink particle detection sensitivity of the ink particle detector can be further improved by detecting the passage of the ink particles by determining whether the output signal from the ink particle detector takes a maximum or minimum value, than by detecting it from the amount of variation with respect to the base line of the signal. This ensures the image printing accuracy of the ink-jet printer to be stabilized in a more reliable manner.

(27) An ink-jet recorder, characterized by comprising;

an ink-jetting head for emitting minute ink particles from nozzles, velocity detection means for detecting the velocity of the ink particles from the detection time of its particles emitted from each nozzle of the aforementioned ink-jetting head, calculation means for calculating the average value of the detection time of the ink particles emitted from each the aforementioned nozzle, and driving controlling means for comparison between a predetermined target value and the average value which has been calculated by the aforementioned calculation means, and modifying the driving conditions of the ink-jetting head so that the average value agrees with the target value.

(28) An ink-jet recorder according to Item (27), characterized by further comprising:

target value changing means for changing the aforementioned target value according to the ambient environmental conditions.

(29) An ink-jet recorder according to Item (27) or (28), characterized in that, the aforementioned driving controlling means determines the driving conditions of the aforementioned ink-jetting head by the value which has been calculated from the difference between the aforementioned target value and the average value that was calculated by the aforementioned calculation means.

(30) The ink-jet recorder according to Item (27) or (28), characterized in that, the aforementioned driving controlling means uses a look-up table to determine the driving conditions of the aforementioned ink-jetting head, based on the difference between the aforementioned target value and the average value calculated by the aforementioned calculation means.

(31) An ink-jet recorder according to Item (29) or (30), characterized in that, when the driving conditions determined in the above-mentioned manner deviate from the conditions for stable emission of ink particles, the aforementioned driving controlling means establishes a specified value as the driving conditions, this specific condition being approximately equal to a marginal value for stable emission.

(32) An ink-jet recorder according to any one of items from (27) to (31), characterized by further comprising:

determining means for determining whether or not the detection time of the ink particles emitted from each nozzle detected by the aforementioned velocity detection means exceeds a predetermined value; and characterized in that the aforementioned calculation means does not include in the calculation of the average value the detection time of ink particles emitted from the nozzle that has been determined to exceed the predetermined value.

(33) An ink-jet recorder according to any one of the items from (27) to (32) above, characterized in that, the aforementioned ink-jet recorder comprises a plurality of the aforementioned ink-jetting heads, and the aforementioned target value is established for each of a plurality of ink-jetting heads.

(34) An ink-jet recorder, characterized by comprising;

an ink-jetting head for emitting minute ink particles from a plurality of nozzles, velocity detection means for detecting the velocity of the ink particles based on the detection time of ink particles from each nozzle of the aforementioned ink-jetting head, movement means for relative movement of the aforementioned ink-jetting head and velocity detection means, an emission controlling means by which, whenever the nozzles of the aforementioned ink-jetting head traverse the velocity detection zone of the aforementioned velocity detection means in the process of relative movement between the ink-jetting head and the velocity detection means by the aforementioned movement means, control is provided so that ink particles are emitted from one or more of all nozzles of the ink-jetting head at the same timed intervals, and a driving controlling means by which the value that has been detected by the aforementioned velocity detection means regarding the emission of each particle of the ink by the aforementioned emission controlling means is compared with a predetermined target value, and the aforementioned driving conditions of the ink-jetting head are modified so that the detected value agrees with the target value.

(35) An ink-jet recorder according to Item (34), characterized in that, the aforementioned emission controlling means provides control so that the emission of ink particles is repeated a plurality of times whenever the nozzles of the aforementioned ink-jetting head traverse the velocity detection zone of the aforementioned velocity detection means, and the detected value compared with the aforementioned target value is an average value based on the value when the emission of ink particles is repeated a plurality of times.

(36) An ink-jet recorder according to Item (34) or (35), characterized by further comprising:

target value changing means for changing the aforementioned target value according to the ambient environmental conditions.

(37) An ink-jet recorder according to any one of Items (34), (35) and (36), characterized in that, the aforementioned ink-jet recorder is characterized in that the aforementioned driving controlling means determines the driving conditions of the aforementioned ink-jetting head according to the value calculated from the difference between the aforementioned target value and the detected value.

(38) An ink-jet recorder according to any one of Items (34), (35)

(36), characterized in that, the aforementioned driving controlling means uses a look-up table to determine the driving conditions changed by the aforementioned ink-jetting head based on the difference between the aforementioned target value and the detected value.

(39) An ink-jet recorder according to any one of Items from (34) to (38), characterized in that, when the driving conditions to be changed deviate from the conditions for stable emission of ink particles, the aforementioned driving controlling means establishes a specified value as the driving conditions, this specific condition being approximately equal to a marginal value for stable emission.

(40) An ink-jet recorder according to any one of items from (34) to (39), characterized by further comprising a plurality of the aforementioned ink-jetting heads, and characterized in that, the aforementioned target value is established for each of the multiple ink-jetting heads.

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENTS

Figure 1:
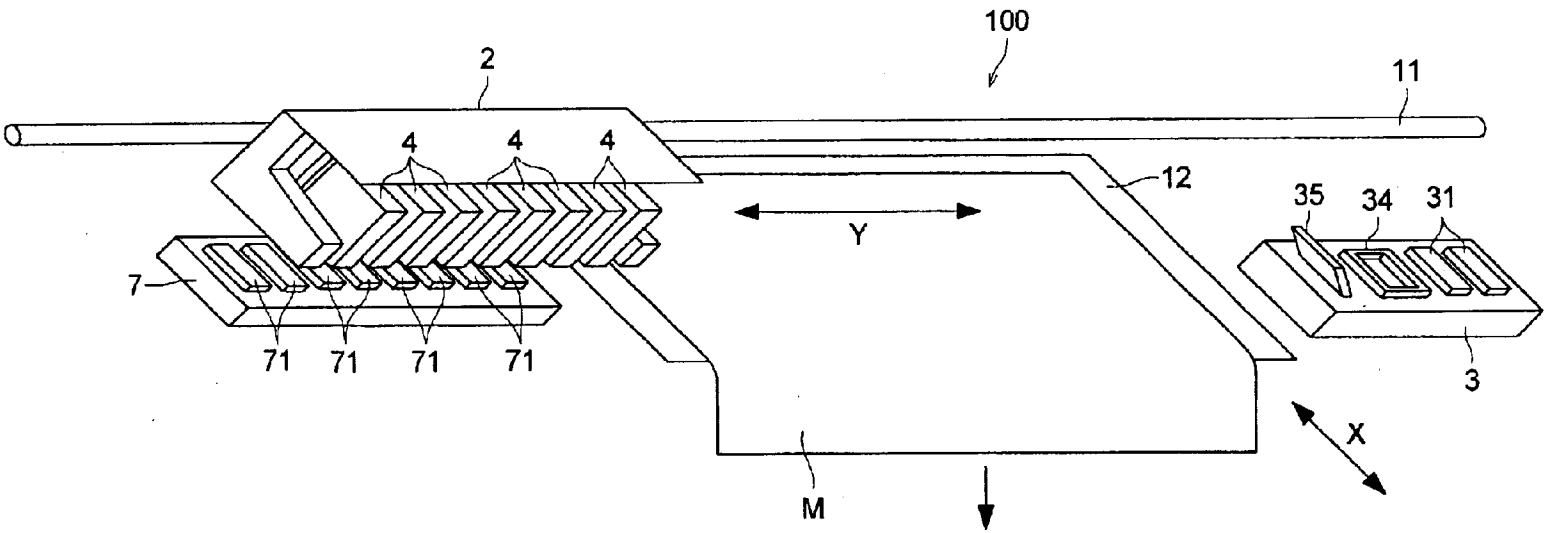
FIG. 1 is a major component perspective view showing the structure of an ink-jet printer pertaining to the present invention.
Figure 2:
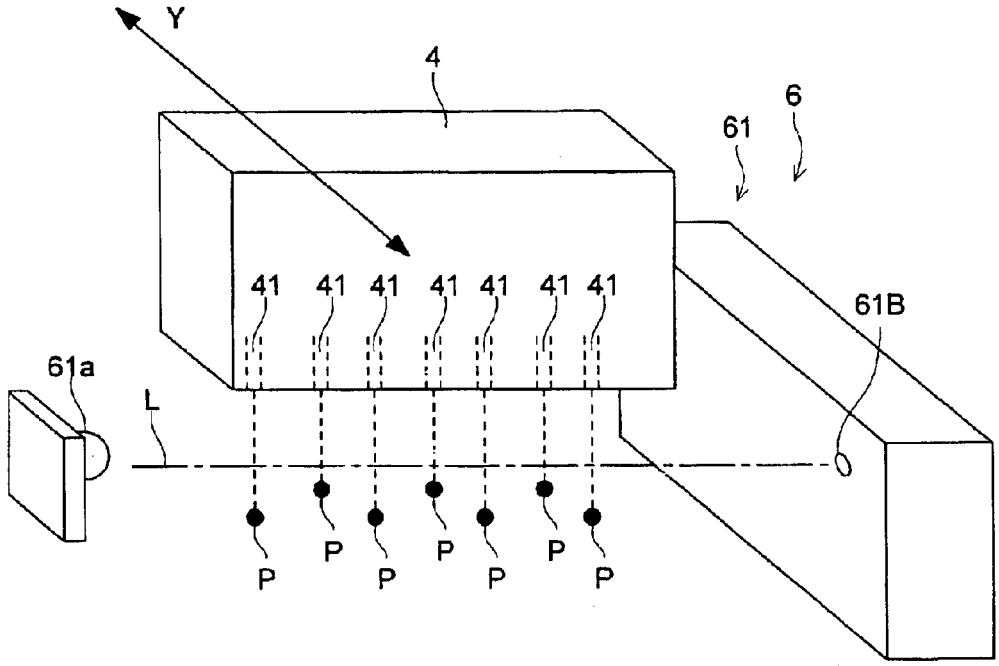
FIG. 2 is a major component perspective view showing the ink-jetting head and velocity measuring means applied to the ink-jet printer in partial perspective form.
Figure 3:
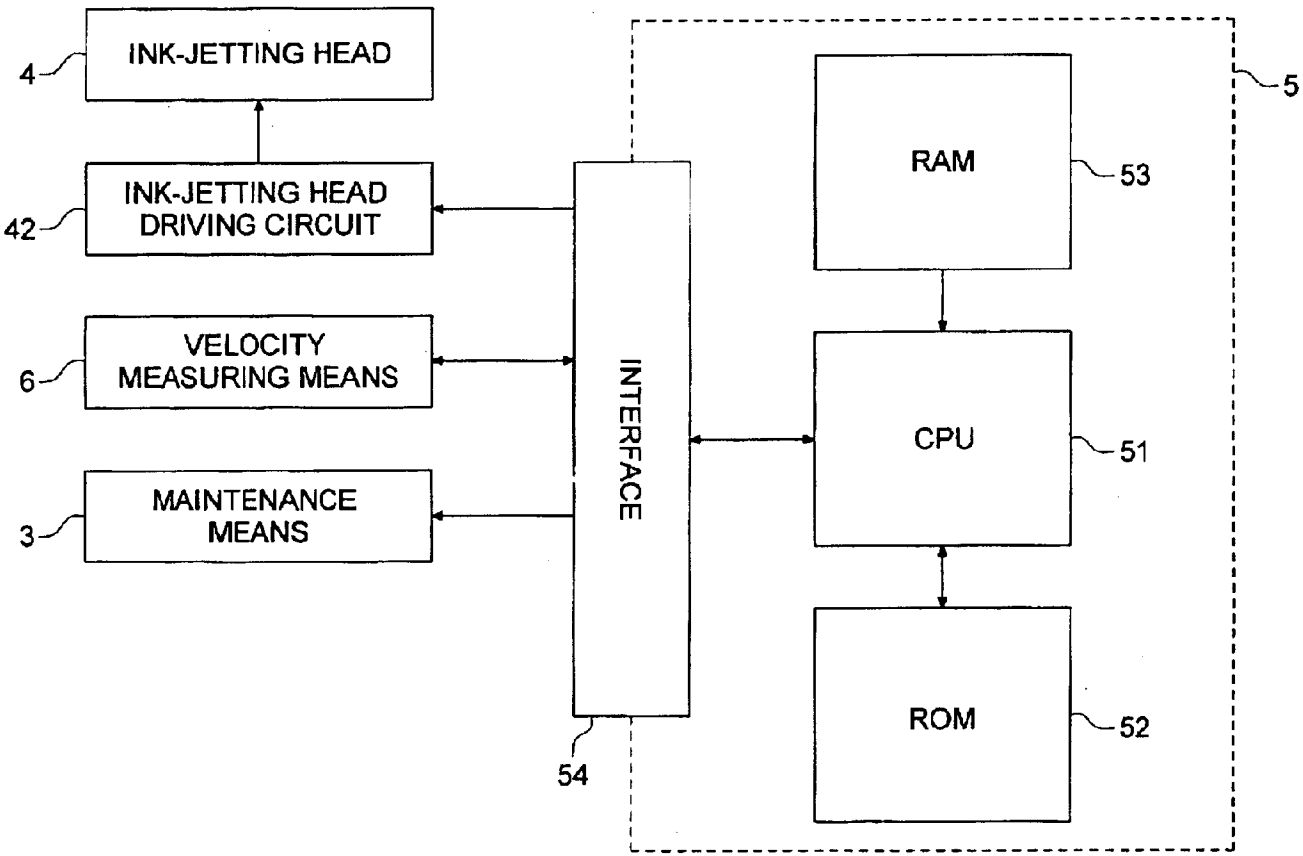
FIG. 3 is a major component block diagram showing the composition of the ink-jet printer.

The ink-jet printer 100 pertaining to a first embodiment of the present invention is described below using figures:

The ink-jet printer 100 pertaining to a first embodiment of the present invention comprises a head carriage 2, maintenance means 3, ink-jetting heads 4, controlling means 5, velocity measuring means 6, head moisture-retaining means 7, a carriage rail 11, a guide member 12, and other components.

When the recording medium M for printing images is carried by carriage means not shown in FIG. 1, the guide member 12 guides the recording medium in the direction of an arrow X in FIG. 1 (in the X-axis direction). The carriage rail 11 is installed in parallel to the direction of an arrow Y in FIG. 1, namely, in the lateral direction of the recording medium M (in the Y-axis direction). The carriage rail 11 is provided with the head carriage 2 described below, and the head carriage 2 is guided in the Y-axis direction.

Depending on the number of colors to be used to print images on the recording medium M, the head carriage 2 contains a plurality of ink-jetting heads 4, 4, . . . (described later), and a plurality of nozzles 41, 41, . . . arranged under the ink-jetting heads. The head carriage 2 is installed to be freely movable in the Y-axis direction with respect to the carriage rail 11 and is moved in the Y-axis direction by the operation of head carriage moving means (not illustrated).

Each ink-jetting head 4 comprises an emission means (not illustrated) and a nozzle 41. The ink-jetting head 4 is connected to the controlling means 5 via an ink-jetting head driving circuit 42. The ink-jetting head driving circuit 42 applies voltage to the emission means in accordance with the control signals T0, T1, . . . that are transmitted from the controlling means 5. One emission means is installed for one nozzle 41 in the form connected thereto, and comprises, for example, a piezo-element.

A plurality of nozzles 41, 41, . . . are installed on the bottom of the ink-jetting head 4 to form a linear bank of nozzles (nozzle line). Voltage is applied to the emission means according to the control signals transmitted from the controlling means 5 based on the image data of the recording medium M, with the result that ink is emitted as particles P from the nozzles 41 connected to the emission means.

At this time, the recording medium M is carried along the surface of the guide member 12 to change the relative positions of the ink heads 4 in the X-axis direction with respect to the recording medium M. Further, the head carriage 2 containing the ink heads 41 is driven by carriage driving means to move along the surface of the carriage rail 11 and thus to change the Y-axis relative positions of the ink heads 4 with respect to the recording medium M. Ink particles P, P, . . . are emitted from the ink-jetting heads 4, 4, . . . in synchronization with the above-mentioned guide member 12 and carriage driving means, and consequently, an image consisting of a set of UV ink particles P, P, . . . is formed on the recording medium M.

As shown in FIG. 1, maintenance means 3 is provided in the proximity to the guide member 12 near the underside of one end of the carriage rail 11, and comprises a suction caps 31, idle emission/collection means 34 and a blade portion 35. Ink suction, idle emission, and other maintenance operations for cleaning are performed on each ink-jetting head 4 by the maintenance means 3 to remove air bubbles, dry ink, dirt, and other potential clogging substances from the nozzles 41, and thus to ensure that each ink-jetting head 4 is capable of emitting ink particles P exactly as designed, thereby allowing a clear image to be printed on the recording medium M with stable accuracy.

Ink emitted from the nozzles 41 is absorbed by the suction caps 31 using the suction force generated by a suction pump (not illustrated). After the suction by the suction caps 31, 31, the blade portion 35 wipes off the ink and other substances sticking in the vicinity of the nozzles 41, 41, . . . .

After the above-mentioned operations, the emission means is filled with clean ink by idle emission of ink particles P from the nozzles 41, 41, . . . to complete the entire step of emission status maintenance. When the idle emission is conducted, the idle-emission/collection means 34 collects the ink idle-emitted from the nozzles 41, 41, . . . . The idle-emission/collection means 34 is, for example, a box-like body with an opening on top, and an ink particle detector 61 (described later) is provided on the inner side of the idle-emission/collection means 34.

The velocity measuring means 6 comprises an ink particle detector 61 and a circuit section 63. In addition to detecting the passage of the ink particles P, P, . . . emitted from the nozzles 41, 41, . . . , the velocity measuring means 6 measures the time differences t1, t2, . . . between the output of control signals T1, T2, . . . from the controlling means 5, and the detection of the ink particles P.

The ink particle detector 61 comprises a light-emitting section 61*a* and a light-receiving section (wave receiving section) 61*b*. The light-emitting section 61*a* and the light-receiving section 61*b* are arranged to face one another on the inner side of, for example, the idle-emission/collection means 34. The light-emitting section 61*a* is, for example, light-emitting diode (LED), and emits light towards the light-receiving section 61*b*. The light-receiving section 61*b* is, for example, a photodiode, and receives light from the light-emitting section 61*a* and then transmits it wherein this light-receiving state is assumed as form a light-receiving signal (wave receiving signal).

The circuit section 63 comprises a current amplification circuit 63*a*, an alternating-current (AC) amplification circuit 63*b*, a peak detection circuit 63*c*, a time counting circuit 63*d*, and an amplitude feedback circuit 63*e*. The circuit section 63 generates detection signals Q0, Q1, . . . based on the changes in the current values of the light-receiving signals which change when the passage of the ink particles P, P, . . . is detected by the light-receiving section 61*b*, and measures the time differences between the output of control signals T0, T1, . . . and the output of detection signals Q0, Q1, . . . .

The current amplification circuit 63*a* amplifies the light-receiving signals sent from the light-receiving section 61*b*. The AC amplification circuit 63*b* further AC-amplifies the light-receiving signals that have been amplified by the current amplification circuit 63*a*. The peak detection circuit 63*c* generates detection signals Q0, Q1, . . . as pulses based on the changes in the current values of the light-receiving signals sent via the AC amplification circuit 63*b*. The time counting circuit 63*d* measures the time differences between the output of control signals T0, T1, . . . and the output of detection signals Q0, Q1, . . . . The amplitude feedback circuit 63*e* adjusts the current and voltage of the electric power supplied to the light-emitting section 61*a* to optimize the current values of the light-receiving signals that are sent from the light-receiving section 61*b* both when ink particles P are detected and when they are not detected.

The head moisture-retaining means 7 comprises moisture-retentive caps 71, 71, . . . in the same number as the ink-jetting heads 4 arranged on the head carriage 2. The head moisture-retaining means 7 humidifies the ink-jetting heads 4 by covering the nozzles 41 with the moisture-retentive caps 71 when the ink-jetting heads 4 are placed in the stand-by mode.

The controlling means 5 controls the, UV ink-jet printer 100. The controlling means 5 comprises a central processing unit (CPU) 51, a read-only memory (ROM) 52, a random access memory (RAM) 53, an interface 54 and other elements, and controls the components of the UV ink-jet printer 1. The controlling means 5 is connected to the ink-jetting heads 4, 4, . . . , the velocity measuring means 6, the maintenance means 3 and other components of the printer via the interface 54.

The CPU 51 performs various computations and judgments based on the information stored in the ROM 52 and the RAM 53, and the information sent from the velocity measuring means 6, and controls components such as the ink-jetting heads 4, 4, . . . . The ROM 52 contains such data as a calculation procedure for the average nozzle values (described later) and average nozzle values, and a method for calculating a predetermined data as the basis for comparison between the average nozzle values and average time differences t'1, t'2, . . . (described later) and between the average nozzle value and average head value. The RAM 53 contains data on the image printed on the recording medium M.

Figure 6:
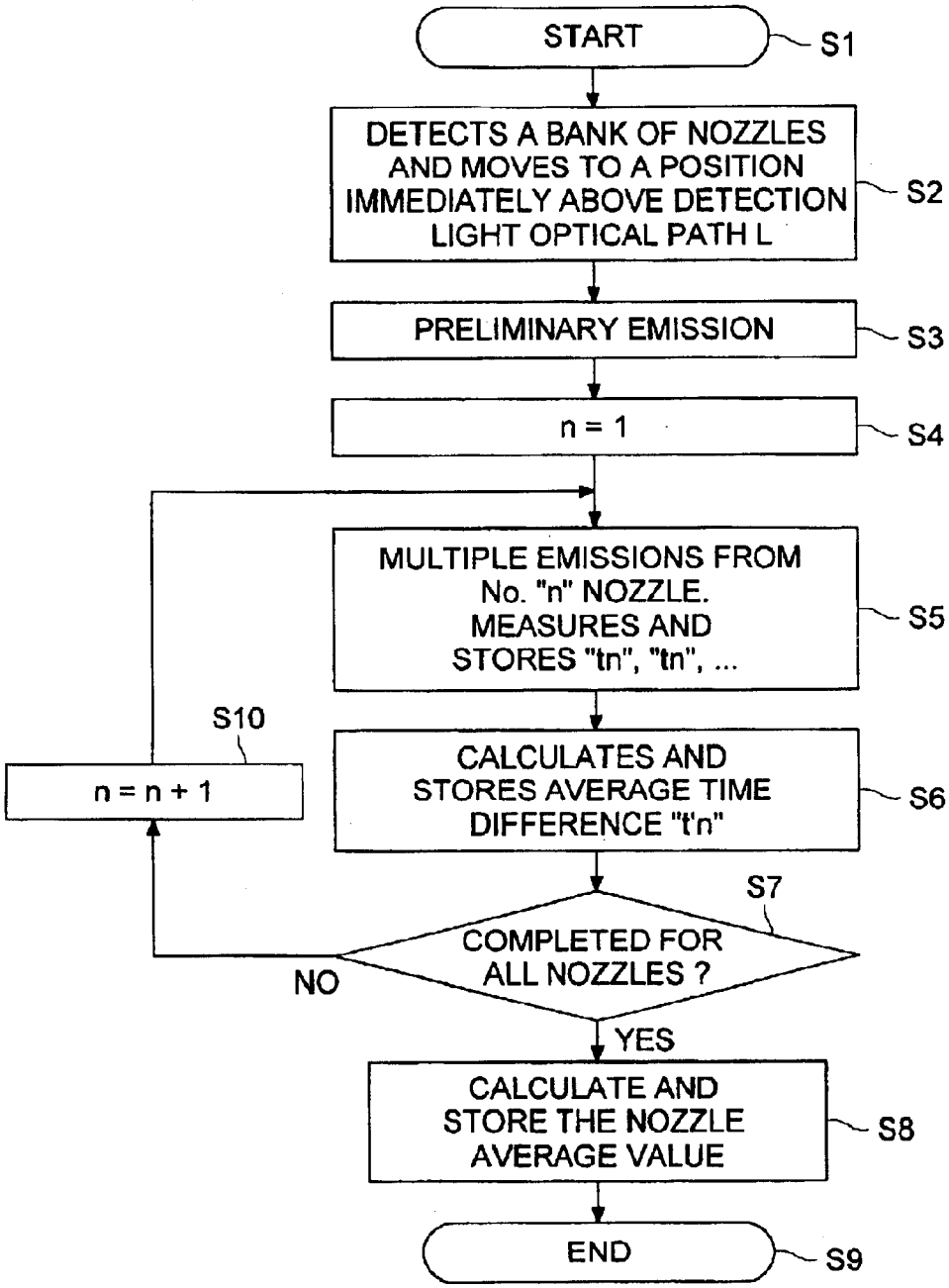
FIG. 6 is a flow hart showing the procedure of measuring the emission velocity in the ink-jet printer.

With reference to the flowchart of FIG. 6, the following describes the procedures for measuring the velocity of ink particles P emitted from each ink-jetting head 4, and for optimizing the voltage applied to the ink-jetting head 4.

First, the head carriage 2 is moved to the vicinity of the maintenance means 3 and then the movement of the head carriage 2 is stopped so that the nozzle line of the ink-jetting head 4 for measuring emission velocity is positioned immediately above the detection optical path L that connects between the light-emitting section 61*a* and light-receiving section 61*b* equipped in the idle-emission/collection means 34 (Step S2).

The above step is followed by idle emission of ink for all nozzles 41 on the nozzle line in accordance with the control signal T0 sent from the controlling means 5. Whereby the nozzles 41 are thus initialized (Step S3, S4).

After the initialization, emission velocity is measured for individual nozzles 41. First, a control signal T1 for emitting ink particles P from the No. 1 nozzle 41 on the nozzle line is sent from the controlling means 5 to the ink-jetting head driving circuit 42. Upon receipt of the control signal T1, the ink-jetting head driving circuit 42 generates the voltage to be applied, and ink particles P are emitted from the No. 1 nozzle 41 (step S5). The number of times ink particles P are emitted from the nozzle 41 is determined in the phase of designing. It is determined in such a way that the error between the average time differences t'1, t'2, . . . (described later) is kept within the practical range.

Figure 5:
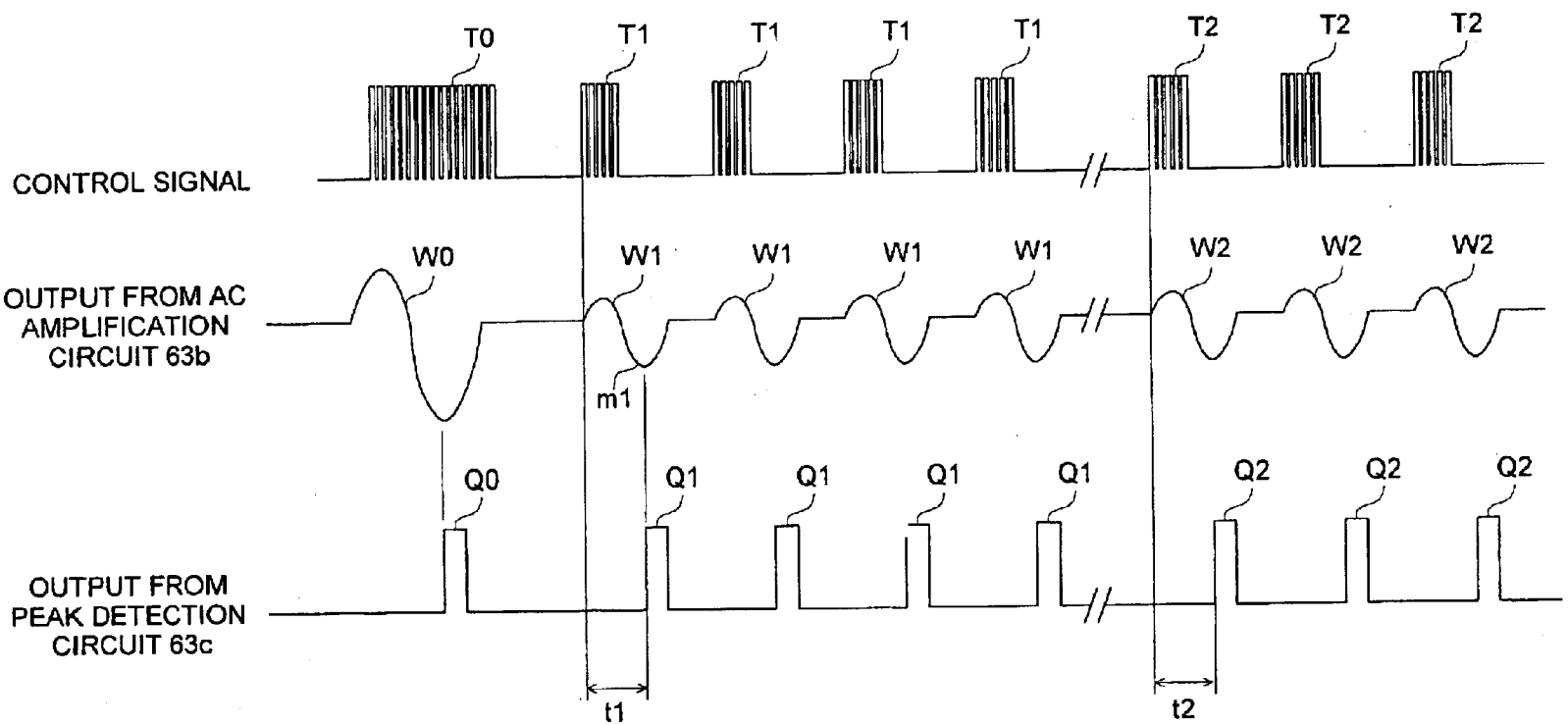
FIG. 5 is a diagram showing examples of the waveforms of the signals processed by the ink-jet printer.

When ink particles P drop in the direction of the idle-emission/collection means 34, these ink particles intercept the detection optical path L located between the light-emitting section 61*a* and the light-receiving section 61*b*. The light-receiving signal sent from the light-receiving section 61*b* at this time changes in cur rent value to provide a detection wave W1. The detection waves W0, W1, . . . that the light-receiving section 61*b* provides upon detection of ink particles P are usually observed in such a way that the current value first increases above the base line when ink particles P are not detected, and returns then to the base line after dropping below this steady state, as shown in FIG. 5.

The detection wave W1 output from the light-receiving section 61*b* is amplified by the current amplification circuit 63*a* and the AC amplification circuit 63*b*, and is sent to the peak detection circuit 63*c*. After differentiating the detection wave W1, the peak detection circuit 63*c* detects the minimal point m1 of the detection wave W1 and then sends detection signal Q1 as a pulse.

The time difference t1 between the output of the control signal T1 and the output of the detection signal Q1 is obtained each time ink particles P, P, . . . are emitted from the No. 1 nozzle 41. The measured time difference t1 is stored into the RAM 53 (S5). After the time difference t1 has been measured a predetermined number of times, the average values of the time differences t1, t1, . . . obtained from each measurement and stored in the RAM 53 are calculated by the CPU 51, and the results are stored as an average time difference t'1 in the RAM 53 of the controlling means 5 (Step S6). The velocity of the ink particles P that are emitted from the No. 1 nozzle 41 is obtained by dividing the distance between the No. 1 nozzle 41 and the point of ink particles P intercepting the detection optical path L, by the average time difference t'1. In the ink-jet printer 100 pertaining to the present invention, this average time difference, t'1, is used as the value denoting the velocity of the ink particles P, P, . . . emitted from the No. 1 nozzle 41.

Subsequently, the operations in steps S5 and S6 are repeated with respect to the No. 2 nozzle 41 and No. 3 nozzles 41, 41, . . . in that order (S7, S10). The time differences t2, t3, between the output of the control signals T2, T3, . . . and the output of the detection signals Q2, Q3, . . . are measured and the measurement results are stored. Then an average value is calculated for each of the time difference t2, t3, . . . by the CPU 51. The results are stored in the RAM 53 as the average time differences t'2, t'3, . . . corresponding to the No. 2 nozzle 41, the No. 3 nozzles 41, 41, . . . . As in the case of the aforementioned average time difference t'1, the average time difference t2, t3, . . . are also used as the values denoting the velocities of the ink particles P emitted from the No. 2 nozzle 41, the No. 3 nozzle 41, . . . .

After average time difference t'2, t'3, . . . have been calculated for all nozzles 41 provided on the ink-jetting head 4, the average value of the average time difference t2, t3, . . . is calculated by the CPU 51 to obtain the average head value of the ink-jetting head 4 (Step S8).

The above step are followed by the step of measuring the emission velocities for the remaining ink-jetting heads 4, 4, according to the same method, and average nozzle values are calculated. These results are stored in the RAM 53. After this, the average value of the average head nozzle values obtained for each of the ink-jetting heads 4, 4, . . . is calculated and the results are stored into the RAM 53 as an average head value.

In this phase, the values for the velocities of the ink particles P emitted from nozzle 41 are originally obtained by detecting the passage of the ink particles P, P, . . . at two separate positions by an ink particle detector, and calculating the time difference in the passage of the ink particles P, P, . . . at the two positions.

On the other hand, in the velocity measuring means 6 of the ink-jet printer 100 pertaining to the present invention, ink particle detector 61 detects the passage of ink particles P, P, . . . at one position only. And the values denoting the velocities of the ink particles P emitted from nozzle 41 are obtained as the time differences t1, t2, . . . between the output of control signals T1, T2, . . . and the detection of the passage of the ink particles P, P, . . . by the ink particle detector 61. In this case, the time when the control signals T1, T2, . . . are sent from the controlling means 5 to the ink-jetting head driving circuit 42, and the time when the ink particles P, P, . . . are emitted from nozzles 41 do not agree with each other, and the velocity data obtained by the velocity measuring means 6 includes errors corresponding to this time difference.

However, the time from the output of the control signals T1, T2, . . . to the emission of the ink particles P, P, . . . from nozzles 41 is almost constant. Thus, the errors occurring in the measurement of velocities are almost offset for the aforementioned reason, when average nozzle values are calculated and the difference between the average time differences t'1, t'2, . . . in each nozzle 41 and the average nozzle values are calculated, or when the average head value is calculated as the average nozzle value of the average nozzle values of individual ink-jetting heads 4 and then the difference between this average head value and each average nozzle value. It can therefore be said that an accuracy level that does not affect the operations (described later) of the ink-jet printer to be performed to ensure an images to be printed with stable accuracy is assigned to the average time differences t'1, t'2, . . . obtained by velocity measuring means 6.

After the average nozzle value of the ink-jetting head 4 has been calculated, comparisons are performed between average time differences t'1, t'2, . . . and the average nozzle value. If any of the average time differences t'1, t'2, . . . is consequently found to deviate from the average nozzle value by more than a predetermined value, the ink-jetting head 4 fails to allow ink particle P to hit the recording medium M at properly timed intervals, and the accuracy of the image printed on the recording medium M is assumed to deteriorate.

In this phase, if there has been detected any one of the nozzles 41 that emits ink particles P, P, . . . with average time differences t'1, t'2, . . . from the average nozzle value by more than a predetermined value, the average time difference t'n of the relevant nozzle 42 will, in most of all those cases, show a value greater than the average nozzle value by more than a predetermined value. In this case, the relevant nozzle 41 is unable to emit ink particles P, P, . . . due to drying of the ink or the entry of dirt or air bubbles therein, with the result that ink particles P, P, . . . will be emitted from this nozzle 41 at a velocity lower than those of the ink particles P, P, . . . emitted from other nozzles 41.

If, as described above, a nozzle 41 unable to emit ink particle has been detected, the ink-jetting head 4 containing such a nozzle 41 will move to the suction caps 31. Then the maintenance means 3 provides the ink-jetting head 4 with such maintenance operations such as ink suction, idle emission and other cleaning operations, thereby recovering the ink-jetting head 4 so that all nozzles 41 can emit ink particles P, P, . . . at the same emission velocity exactly as designed.

When the ink-jetting head 4 where the nozzle 41 incapable to emit ink particles has been detected as described above is provided with maintenance operations, similar maintenance can also be conducted for all other ink-jetting heads 4 where nozzles 41 unable to emit ink particles are not found out.

The predetermined value used as the basis for comparison between the average time differences t'1, t'2, . . . and the average nozzle value is to be determined within the range where image printing accuracy printed on the recording medium M is maintained at the level required for each printing operation, by statistical processing of the average time differences t'1, t'2, . . . based on the results of the test conducted on the ink-jet printer 100 and the characteristics of the ink-jetting head 4.

The average nozzle values of individual ink-jetting heads 4 and the average head value are also compared. If the average nozzle value is found to deviate from the average head value by more than a predetermined value, this deviation is assumed to reduce the accuracy of the image printed on the recording medium M. The average nozzle value is corrected by correcting the voltage applied to this ink-jetting head 4.

After the setting of the voltage to be applied to the corresponding ink-jetting head 4 has been corrected, average time differences t'1, t'2, . . . of the ink-jetting head 4 are measured again. Then the nozzle values is calculated and the result is compared with the average head value again. After this, if the difference between corrected average nozzle value and average head value stays within the predetermined data range, correction of the voltage applied will be completed. If the above difference exceeds the predetermined data range, correction of the voltage applied will continue. Since the voltage applied to the ink-jetting heads 4 is corrected in this way, all ink particles P, P, . . . emitted from the ink-jetting heads 4 hits the recording medium M at the same timed intervals, and images are printed thereon with high stability.

The applied voltage, however, is not corrected if the differences between the average nozzle values obtained for the ink-jetting heads 4 and the average head value as the average value of these average nozzle values stay within a predetermined data range.

Here the predetermined value used as the basis for comparison between the average nozzle value and average head value is to be determined within the range where image printing accuracy printed on the recording medium M is maintained at the level required for each printing operation, by statistical processing of the average nozzle value based on the results of the test conducted on the ink-jet printer 100 and the characteristics of the ink-jetting head 4.

The correction value for correcting the voltage to be applied to the ink-jetting head 4 is obtained as, for example, the product derived by multiplying the difference between the average nozzle values and the average head value by a fixed proportionality constant, and this proportionality constant is calculated using an experimental means based on the characteristics of the ink-jetting head 4.

In this way, the ink-jet printer 100 pertaining to the present invention can continue printing images onto recording medium M with stable accuracy, as described above, by measuring, at appropriate time intervals, the time differences t'1, t'2, as the values denoting the velocities of ink particles P, P, - - - emitted from the ink-jetting heads 4, 4, - - - , and then by cleaning the ink-jetting heads 4, 4, - - - and correcting applied voltage whenever required.

As described above, the values denoting the velocities of the ink particles P, P, - - - emitted from the nozzles 41 of each ink-jetting head 4 are compared with the respective average nozzle values. If there has been detected any nozzle 41 where the velocity of the particles P, P, - - - differs by more than a predetermined value, this ink-jetting head 4 is provided with maintenance such as cleaning. This ensures at all times that all ink particles P, P, - - - are emitted from the ink-jetting heads 4 at the same timed intervals, and makes it possible to provide an ink-jet printer capable of printing images with stable accuracy.

By finding the nozzles 41, 41, - - - where emission velocity P of ink particles has been reduced, it is possible to prevent nozzles 41, 41, - - - from becoming unable to emit ink particle due to entry of air bubbles or clogging with dirt. This ensures easy maintenance of the ink-jetting heads 4.

The average nozzle values and average head values of ink-jetting heads 4, 4, - - - are compared. If any one of the average nozzle values deviates from the average head value by more than a predetermined value, the voltage applied to the relevant ink-jetting head 4 is corrected, whereby the velocities of the ink particles P, P, - - - are corrected. This ensures that all ink particles P, P, - - - are emitted from the ink-jetting heads 4, 4, - - - at the same timed intervals. This also makes it possible to provide an ink-jet printer capable of printing images with stable accuracy.

Further, the velocity measuring means 6 calculates the average time differences t'1, t'2, - - - between the output of control signals T1, T2, - - - and the output of detection signals Q1, Q2, - - - and uses these average time differences as the values denoting the velocities of the ink particles P, P, - - - emitted from each nozzle 41. This makes it possible to create velocity measuring means 6 capable of measuring the emission velocities of ink particles P, P, - - - with the accuracy level required to optimize ink emission of the ink-jetting heads 4, 4, - - - , more easily than conventional velocity measuring means that detects the passage of ink particles P, P, - - - at two positions. Thus, the velocity measuring means 6 can be created at reduced costs and its maintenance becomes easier.

Furthermore, the velocity measuring means 6 detects the passage of ink particles, P, P, - - - by determining whether the light-receiving signal value of the ink particle detector 61 takes the maximum or minimum value. This improves sensitivity of the velocity measuring means 6 in detecting ink particles P, P, - - - .

If the velocities of ink particles P, P, - - - are measured, the ink particles P, P, - - - are generally detected when the current values of the light-receiving signals change from the base line by more than a predetermined threshold value. In this case, however, if the actual change in the current value of the light-receiving signal occurring when the detection optical path L is intercepted by ink particles P, P, - - - is smaller than the above threshold value, ink particles P are not detected. This may have an adverse effect on the measurement of the velocities of ink particles P, P, - - - , according to the prior art. The velocity measuring means 6 pertaining to the present invention, however, detects the minimum or maximum light-receiving signal value, thereby detecting ink particles P, P, - - - independently of the variation of the light-receiving signal value from the base line. Thus, the image printing accuracy of the ink-jet printer 100 is further stabilized by more reliable measurement of the velocities of ink particles P, P, - - - .

It should be noted that the ink-jet printer 100 pertaining to the present invention is not limited to the embodiments described above. For example, if the idle emission process for a series of maintenance operations for the ink-jetting heads 4, 4, - - - is implemented by the head moisture-retaining means 7, it is possible to install the ink particle detector 61 on the head moisture-retaining means 7 or to mount the ink particle detector 61 on other than the maintenance means 3 or the head moisture-retaining means 7. These arrangements provide the same effects as those of the aforementioned embodiments of the ink-jet printer 100.

In the above embodiment, the average time differences t'1, t'2, - - - between the output of control signals T1, T2, - - - and the output of detection signals Q1, Q2, - - - are used as the values denoting the velocities of the ink particles P, P, - - - emitted from each nozzle 41. However, the ink-jet printer 100 pertaining to the present invention is not limited to this embodiment. For example, it is possible to provide the ink-jetting heads 4, 4, - - - with maintenance operations and correction of the voltage to be applied after the velocities of the ink particles P, P, - - - emitted from each nozzle 41 are calculated from average time differences t'1, t'2, - - - , and the average nozzle values and average head values are then calculated from these velocities, following by the step of various comparisons.

In the above embodiment, emission process for obtaining the velocities of ink particles P, P, - - - and measurement of a time difference "tn" are repeated many times for one nozzle 41. In the ink-jet printer 100 pertaining to the present invention, it is also possible to perform emission and measurement of time difference "tn" only once for one nozzle 41.

Further, ink emission in the ink-jet printer 100 pertaining to the present invention is not limited to the embodiment where a piezo-element is used to emit ink particles. For example, ink can be emitted by heat using a heater.

Figure 7:
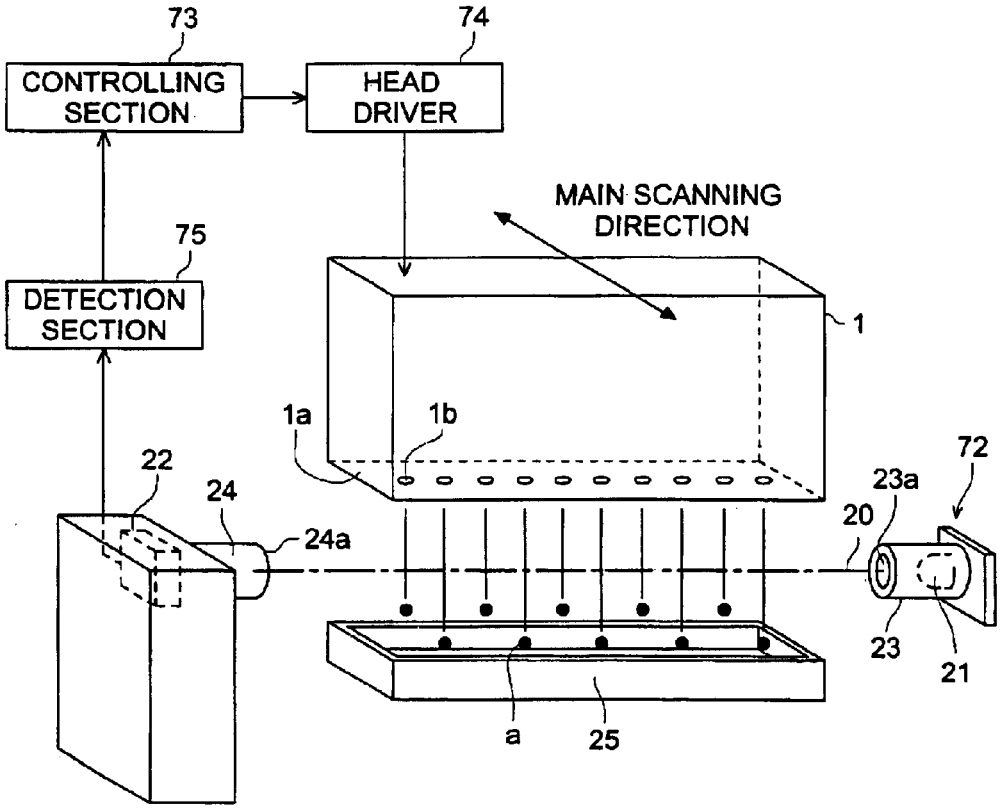
FIG. 7 is a schematic view showing the structure of the main component blocks in the ink-jet recorder pertaining to the present invention.

The following describes a second embodiment of the present invention with reference to drawings:

FIG. 7 is a schematic view showing the arrangement of the major components of the ink-jet recorder as a second embodiment of the present invention. Numeral 1 in the figure denotes an ink-jetting head. On the head surface 1*a* facing downward, a plurality of nozzles 1*b*, 1*b*, - - - are arranged linearly in a direction perpendicular to the main-scanning direction of the ink-jetting head 1. Ink is emitted downward (in FIG. 7) from each nozzle 1*b* as very small drops of ink "a" at timed intervals so that a desired image can be formed on a recording medium (not illustrated).

Numeral 72 denotes velocity-measuring means that detects the moving velocity of the ink particles "a" emitted from each of nozzles 1*b*, 1*b*, - - - of the ink-jetting head 1. The velocity measuring means 72 is provided where the ink-jetting head 1 does not record on the recording medium. The velocity measuring means 72 is installed in such a way that a light-emitting element 21 for emitting detection light and a light-receiving element 22 for receiving the detection light emitted from the light-emitting element 21 are provided to face each other at a distance that allows the ink-jetting head 1 to be installed in-between, and the optical axis 20 of the detection light is perpendicular to the main-scanning direction of the ink-jetting head 1 and parallel to the direction in which the nozzles 1*b*, 1*b*, - - - of the ink-jetting head 1 are arranged. Such arrangement of the light-emitting element 21 and the light-receiving element 22 ensures that, when the ink-jetting head 1 is positioned in-between, the passage route for the ink particles "a" emitted from each of nozzles 1*b*, 1*b*, - - - intersects the optical axis 20 of the detection light.

According to this embodiment, the moving velocity of the ink particles "a" at this time is detected by optical detection of the ink particles via the light-emitting element 21 and the light-receiving element 22. To be more specific, the moving velocity of the ink particles "a" can be determined from the distance between the head surface 1*a* of the ink-jetting head 1 and the optical axis 20 of the detection light and from the time between the start of emission of the ink particles "a" and completion of the passage thereof through the optical axis 20. This detection process for the moving velocity can be accomplished by calculating it from the distance and time mentioned above. Alternatively, the detection time value can be taken as the moving velocity because the distance from the head surface 1*a* of the ink-jetting head 1 to the optical axis 20 of the detection light is constant, so the time from the start of emission of the ink particles "a" to completion of the passage thereof through the optical axis 20 can be regarded as equivalent to the moving velocity of the ink particles "a". The latter method is described below.

The light-emitting element 21 and the light-receiving element 22 are mounted on enclosures 23 and 24, respectively, that optically intercepts light. The enclosure 23 of the light-emitting element 21 has a light-emitting opening 23*a* formed to emit detection light from the light-emitting element 21 in the direction of the light-receiving element 22. The enclosure 24 of the light-receiving element 22 has a light-receiving opening 24*a* formed to receive detection light from the light-emitting element 21 and enable received detection light to be detected by the light-receiving element 22.

Figure 8:
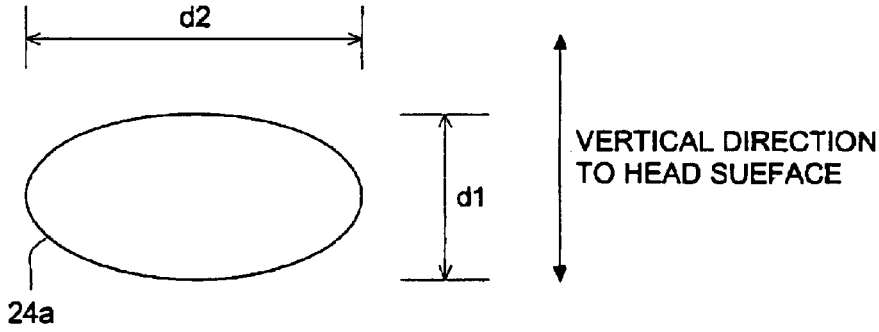
FIG. 8 is a front view showing the shape of a light-receiving opening.

As shown in FIG. 8, the light-receiving opening 24*a* assumes an elliptic shape where the diameter d1 in the direction (minor diameter) vertical to the head surface 1*a* of the ink-jetting head 1 is smaller than the diameter d2 (major diameter) in the direction orthogonal to the minor diameter. Normally, the light-receiving opening 24*a* is preferred to have a smaller width in the direction vertical to the head surface 1*a* of the ink-jetting head 1 where ink particles "a" are emitted, because it improves accuracy of detecting the velocity of the ink particles "a". However, if the width orthogonal thereto is reduced, the signal detected via the light-receiving element 22 will decrease in output, and stable detection is adversely effected by the resulting decrease in the degree of allowance for the deviation of the optical axis of the ink-jetting head 1 in the main-scanning direction, resulting in increased detection errors. To avoid such an adverse effect, the opening is formed to have an elliptic shape as shown in FIG. 8, and is arranged in the enclosure 24 of the light-receiving element 22 to ensure that the minor diameter is positioned along the direction vertical to the head surface 1*a* of the ink-jetting head 1 whereby improved accuracy in detecting ink particles "a" and reduced detection errors are both ensured at the same time. For example, a typical light-receiving opening 24*a* has a shape of d1=1.5 mm and d2=3.0 mm.

Numeral 25 in FIG. 7 denotes an ink-receiving pan disposed facing the head surface 1*a* of the ink-jetting head 1 to receive ink particles "a" emitted from the ink-jetting head 1.

Figure 9:
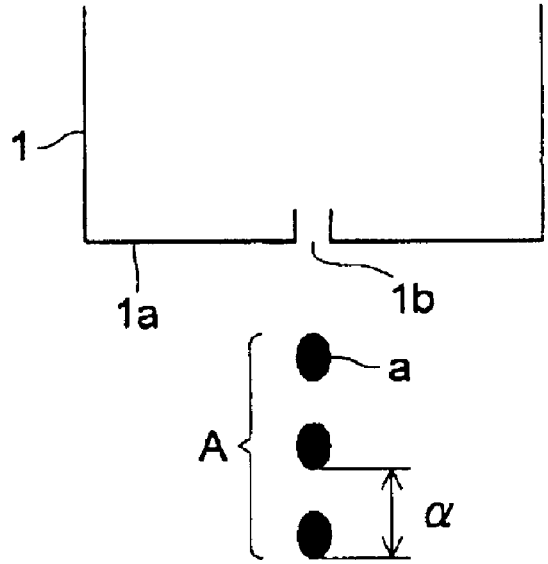
FIG. 9 is a view showing how ink particles are emitted during the detection operation of velocity detection means.

In the second embodiment, the drive of the head driver 74 is controlled by the controlling section 73 when the ink-jetting head 1 during detection of ink particle velocity is stopped where detection is performed by the velocity detection means 72, i.e. where the entire nozzle line of the ink-jetting head 1 is positioned on the optical axis 20. This allows driving voltage to be applied to the ink-jetting head 1, and emission of ink particles "a" is controlled. As shown in FIG. 9, the emission of ink from the ink-jetting head 1 at this time is controlled in terms of one cluster of ink A, not in terms of a plurality of continuous ink particles "a". The emission interval among individual ink particles "a" in one cluster of ink A has a value smaller than the distance (d1) along the ink emission direction of the light-receiving opening 24*a*. This arrangement allows the signal output from the light-receiving element 22 to be received as one cluster of signals representing clusters of ink A.

The number of ink particles "a" in one cluster of ink A denotes the number determined in such a way that when the cluster of ink is formed, the length of this cluster is smaller than the detection distance (d1) of the velocity detection means 72. It can be determined as appropriate according to the size of the ink particles "a" and detection distance of the velocity detection means 72.

The shadow of each of the ink particles "a" which have been emitted as a cluster of ink A from the nozzle 1*b* of the ink-jetting head 1 is captured by the light-receiving element 22 through passage through the optical axis 20, and is sent to a detection section 75 as a detection signal of the light-receiving element 22 that denotes the change in the amount of light.

The following describes velocity detection of ink particles "a" by the velocity detection means 2 with reference to FIGS. 7 and 10–13.

After lighting up the light-emitting element 21 in step SP1, the controlling section 73 drives the head driver 74, sends a FIRE-M signal as an emission starting signal (see FIG. 12), and emits ink particles "a" as a cluster of ink A only from the No. 1 nozzle out of the nozzles 1*b*, 1*b*, - - - of the ink-jetting head 1 (SP2 and SP3).

The cluster of ink A that has been emitted from the No. 1 nozzle partly intercepts the detection light on the light-receiving element 22 by passing through the optical axis 20 of the velocity detection means 72. Then the signal for the amount of light received temporarily decreases in level.

Figure 11:
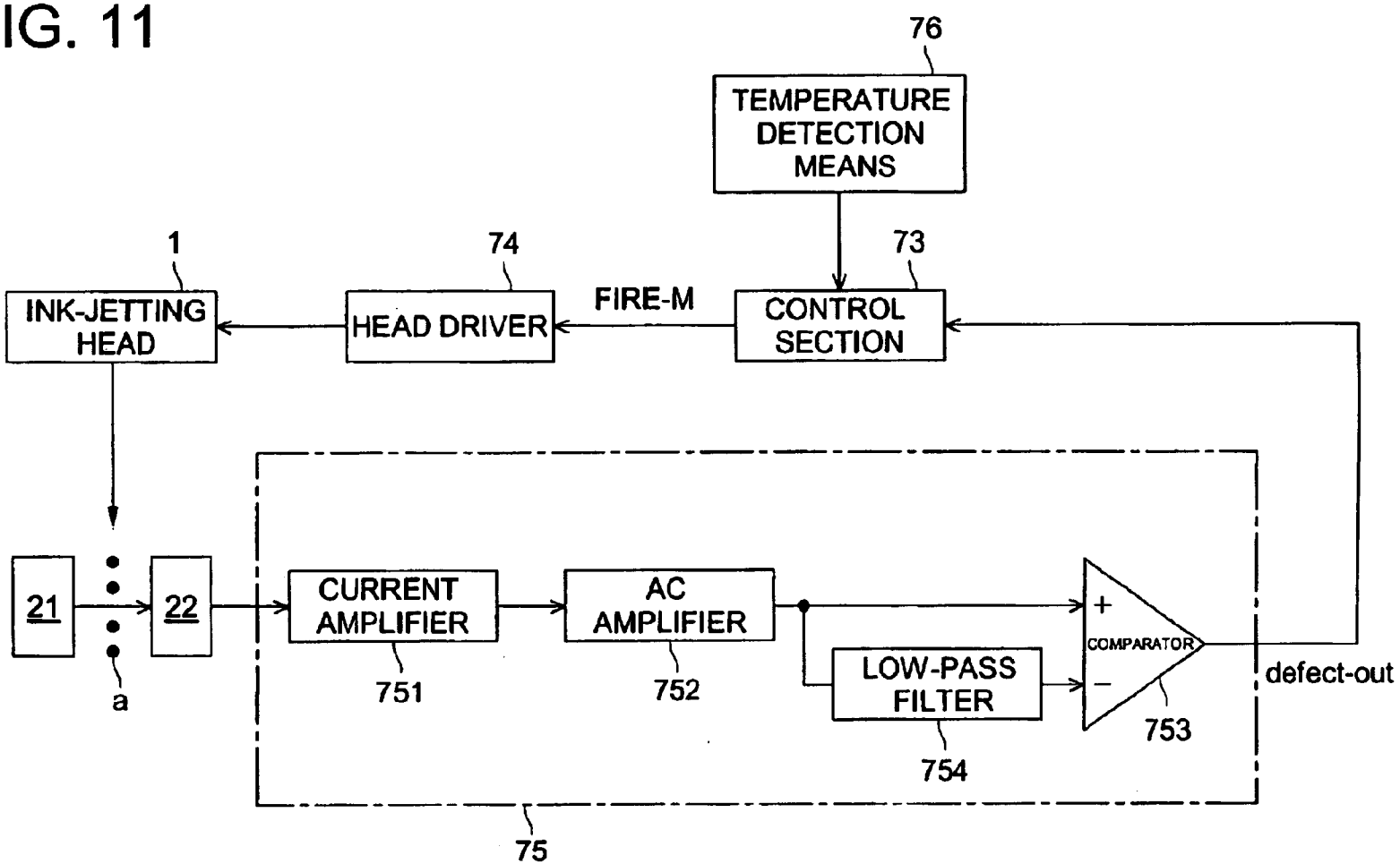
FIG. 11 is a block diagram showing the composition of the velocity detection means.
Figure 12:
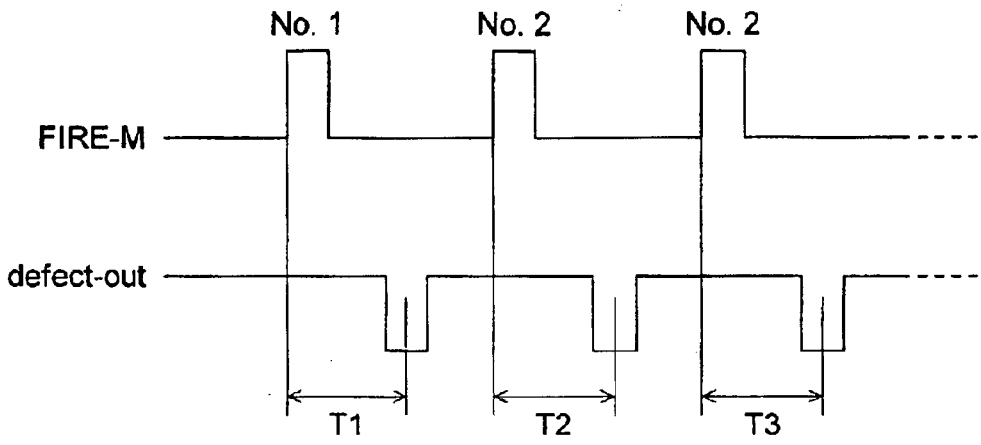
FIG. 12 is a timing chart of an emission starting signal and detection signal.

As shown in FIG. 11, the detection section 75 amplifies the amount-of-light signal of the light-receiving element 22 using a current amplifier 751, and amplifies only the change in this signal level using an AC amplifier 752 to obtain the signal to be used for comparison with a reference signal. Then a comparator 753 compares this signal with the reference signal that has been created via a low-pass filter 754. It detects only signal change that exceeds the reference signal level. More specifically, after the cluster of ink A for velocity detection has been emitted from the No. 1 nozzle and has passed through the optical axis 20, changes of the signal exceeding the reference signal level are detected by the comparator 753 and the defect-out output signal starts falling (see FIG. 12).

Figure 13:
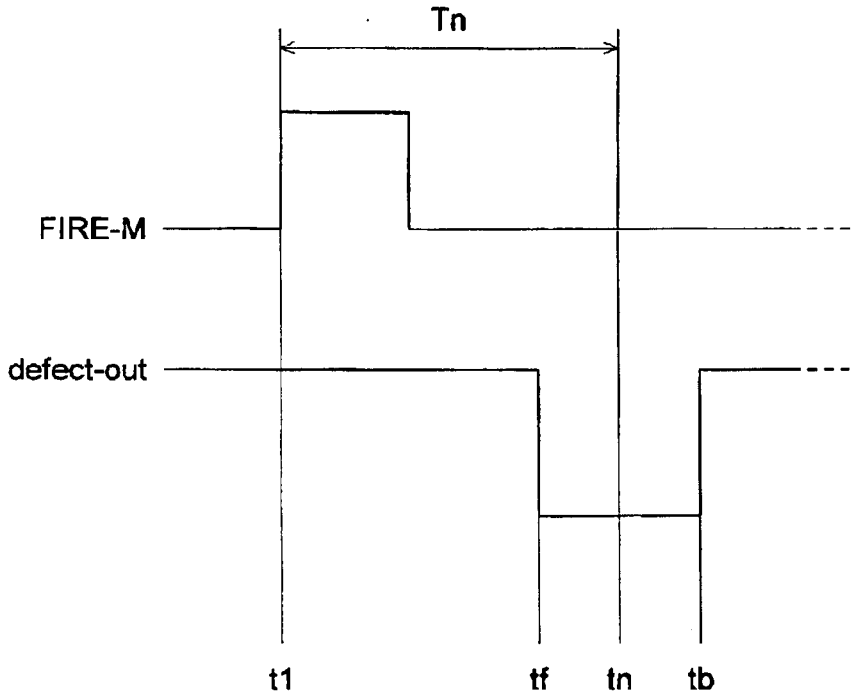
FIG. 13 is a timing chart of an emission starting signal and detection signal.

In the controlling section 73, the time "Tn" from the time "t1" of the emission starting signal (FIRE-M) being output to the ink-jetting head 1 to the median value "tn" between the falling time of the defect-out signal and the rising time thereof is detected and stored into memory (step SP4), as shown in FIG. 13. Since the distance from the head surface 1*a* of the ink-jetting head 1 to the optical axis 20 of the detection light is constant, the detection time "Tn" can be regarded as equivalent to the moving velocity of the ink particles "a". After that, the controlling section 73 performs the detection operation for No. 2 nozzle, No. 3 nozzle and so on up to the last nozzle in that order according to steps SP2 and SP3 (SP5).

After the aforementioned detection has ended for all nozzles of the ink-jetting head 1, the light-emitting element 21 is turned off (Step 6). Then the controlling section 73 calculates an average value based on the detection time for each nozzle of the ink-jetting head 1 (Step 7).

In this case, there may be some nozzles 1*b*, 1*b*, - - - where detection time is extremely long or short, depending on the variance among the nozzles 1*b*, 1*b*, - - - of the ink-jetting head 1. If the detection time of such nozzles is included in the calculation of an average value, the resulting increase in error rate will make it difficult to accurately correct deviations in the position hit by ink particles, even if, as described later, the driving conditions of the ink-jetting head 1 are modified. To solve this problem, the controlling section 73 comprises decision means for determining whether or not the detection time for each nozzle detected by the velocity detection means 72 deviates by more than a predetermined value. The detection time of the nozzle determined by the above decision means to deviate by more than a predetermined value in terms of detection time is excluded from the calculation of its average value.

The decision of whether or not the detection time of each nozzle deviates by more than a predetermined value can be accomplished using various methods. For example, an average value is calculated from the detection time of all nozzles. Then decision is made to see whether or not the value deviates from that average value by more than a predetermined value (for example, 150 sec). After that, an average value is re-calculated from data without the detection time of deviating nozzle(s). Another example of these methods is that, prior to the calculation of an average value from the detection time of all nozzles, comparison is made between the detection time of each nozzle and a predetermined value (for example, the target value described later). Then decision is made to see whether or not the value deviates from that value by more than a predetermined value (for example, 150 sec). After that, an average value is re-calculated from data without the detection time of deviating nozzle(s).

After the average value has been calculated in the manner described above, the controlling section 73 compares this average value with the predetermined target value stored therein (Step 8).

This target value is defined as an ideal value denoting the moving velocity (moving time) at which ink particles "a" emitted from the ink-jetting head 1 during movement in the main-scanning direction hit appropriate positions on the recording medium. It is predetermined from the main-scanning speed of the ink-jetting head 1 and the distance between the head surface 1*a* thereof and the recording medium.

It is preferable that this target value be changed according to the ambient environmental conditions. For example, temperature detection means 76 such as a temperature sensor is arranged close to each nozzle 1*b* of the ink-jetting head 1 or on an ink supply tube, an ink tank and/or the like to ensure that an environmental temperature can be appropriately detected. As shown in FIG. 11, the aforementioned temperature detection means 76 is connected to the controlling section 73, and the above target value is changed according to the ambient environmental temperature which has been detected by the temperature detection means 76. Especially when ink viscosity depends on temperature characteristics, the moving velocities of ink particles undergo a delicate change according to temperature. So deviations in the position hit by ink particles can be corrected more accurately by changing the target value according to the ambient temperature. Modification data for this target value can be obtained from the computation by the controlling section 73 based on the detected temperature or by using a table where the relationship between the temperature and the target value is predefined.

Controlling section 73 compares the calculated average value with the target value to calculate the difference between both. This difference denotes the deviation from the appropriate position hit by ink particles "a" emitted from the ink-jetting head 1. In order to remove this difference, therefore, conditions for driving the ink-jetting head 1 are to be determined (SP9) to ensure that the average value and the target value match each other. The position of ink particles emitted from each of nozzles 1*b*, 1*b*, - - - hitting the recording media can be matched to the appropriate position for the entire recording head 1 to a nearly satisfactory level by changing the conditions for driving the ink-jetting head 1 so that the average value and the target value match each other.

These driving conditions can be determined from the data obtained by providing arithmetic processing based on the difference between the target value and the average value, or the data obtained from the difference between them by using a look-up table. According to the former step, the driving conditions of the ink-jetting head 1 to be modified can be determined in details according to the difference between the target value and the average value. This step provides the advantage of ensuring more accurate image recording. The latter step provides the advantage of rapid determination using a look-up table.

Figure 14:
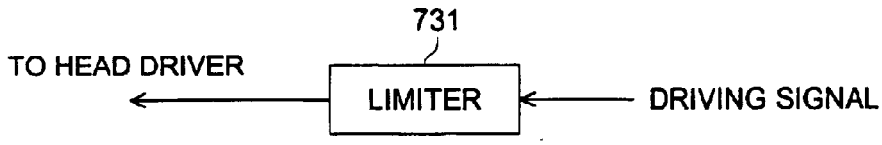
FIGS. 14(*a*) and (*b*) are diagrams showing the composition of controlling means equipped with a limiters.
Figure 14:
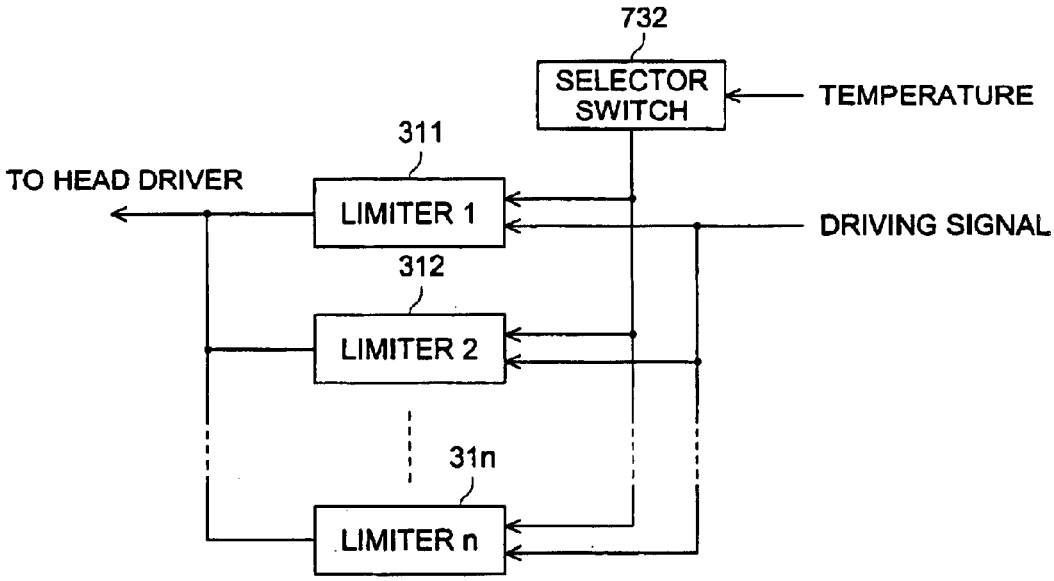

Incidentally, there is a limit to the driving conditions of the ink-jetting head. For example, if an excessive driving signal is given, the quantity of ink emitted will increase and this will cause trouble when ink is recharged into the ink chamber following the emission of ink. This will result in unstable ink emission due to entry of air. Conversely, if the driving signal level is too small, a similar problem of unstable ink emission including complete failure of ink emission will arise. To solve this problem, the controlling section 73 is provided with a limiter 731 which keeps driving signals within the range where there is no departure from the stable emission conditions of the ink-jetting head 1, as shown in FIG. 14. If a driving signal deviating from these conditions is applied, a value close to the threshold value for stable emission is set as a driving signal value. If the driving signal level corresponding to the driving conditions determined in the aforementioned manner deviates from the stable emission conditions of the ink-jetting head 1, a driving signal value close to the threshold value for stable emission is sent from the limiter 731 to the head driver 74 to ensure that stable emission is maintained at all times, thereby ensuring high-quality image recording.

As shown in FIG. 14(*b*), a plurality of limiters 311, 312 and so on up to 31*n* for setting the threshold value for the appropriate stable emission conditions according to environmental temperature in such a way that an appropriate limiter can be selected by a selector switch 732 according to the ambient environmental temperature detected by the temperature detection means 76. This step is preferable because, when the driving signal level corresponding to the determined driving conditions deviates from the stable emission conditions of the ink-jetting head 1, the threshold value for the appropriate driving signal according to the detected ambient environmental temperature can be set, thereby ensuring images of higher quality to be recorded.

The driving conditions determined in the aforementioned manner are turned in to driving signal applied to the ink-jetting head 1 when an image is recorded. The controlling section 73 sends the driving signal to the head driver 74 during image recording, thereby reducing a cause for image deterioration due to deviations in the position hit by ink particles and ensuring high-quality image recording.

Figure 15:
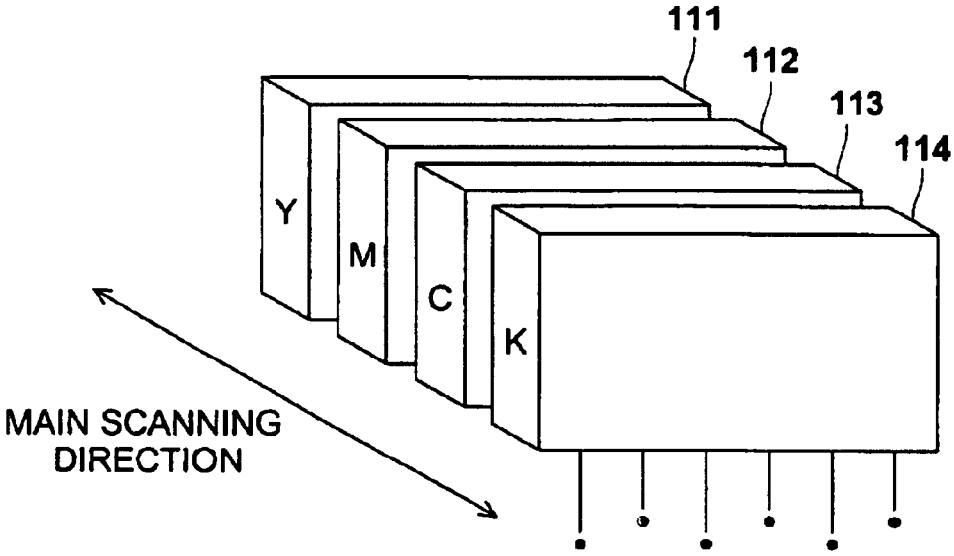
FIG. 15 is a schematic perspective view of the ink-jetting heads provided for each color.
Figure 16:
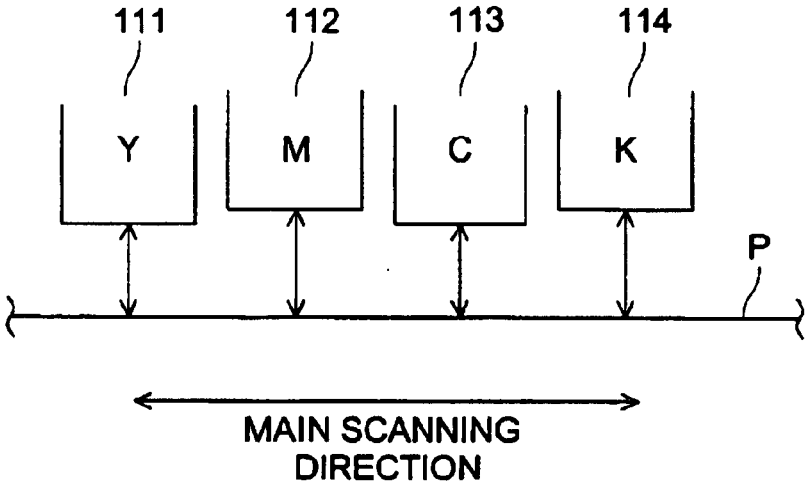
FIG. 16 is a diagram explaining the relationship between the ink-jetting heads provided for each color and a recording medium.

The number of ink-jetting heads is not restricted to one. As shown in FIG. 15, the ink-jetting head can consist of a plurality of independent ink-jetting heads 111, 112, 113 and 114 for respective colors (for example, Y, M, C, and K). For an ink-jet recorder having such a plurality of ink-jetting heads 111, 112, - - - , it is preferable that the above target value be set for each of the ink-jetting heads 111, 112, - - - independently. When a plurality of ink-jetting heads 111, 112, - - - are provided in this way, there may be variations in mounting accuracy among the ink-jetting heads 111, 112, - - - , as shown in FIG. 16. This may deteriorate uniformity of the distance between each head surface and recording medium P to cause deviations. When moving velocities of ink particles emitted from each ink-jetting head are the same, deviation may occur for each color due to the differences in moving distance among ink-jetting heads. For these multiple ink-jetting heads 111, 112, - - - , the problem of deviations in the position hit by ink particles for each color can be solved by using target values preset for each ink-jetting head and modifying the respective driving conditions as described above, with the result that high-quality color images can be recorded.

Figure 17:
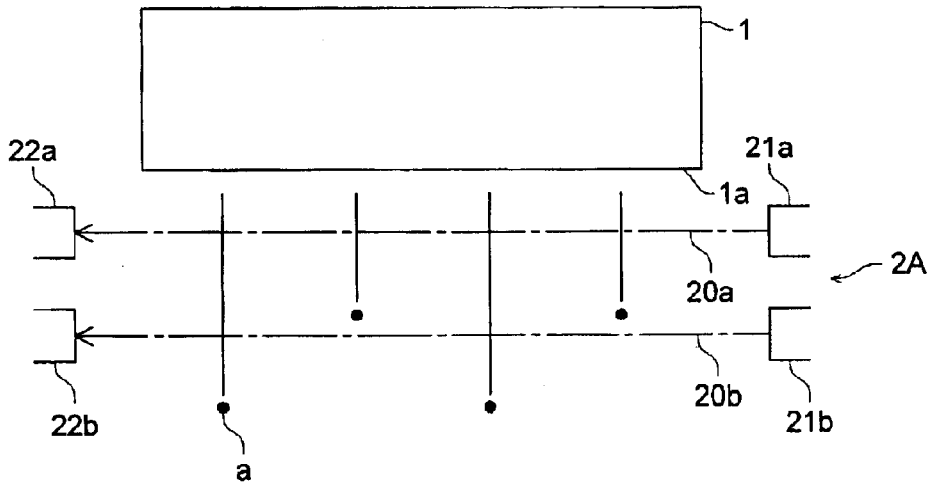
FIG. 17 is a schematic block diagram showing another example of the velocity detection means.
Figure 18:
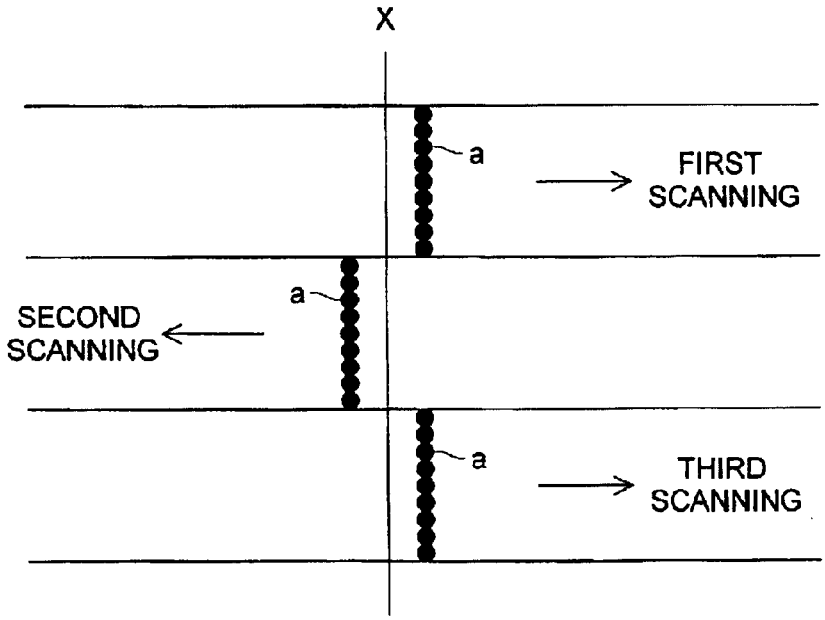
FIG. 18 is an explanatory diagram showing deviations in the positions hit by ink particles emitted from the ink-jetting heads.
Figure 19:
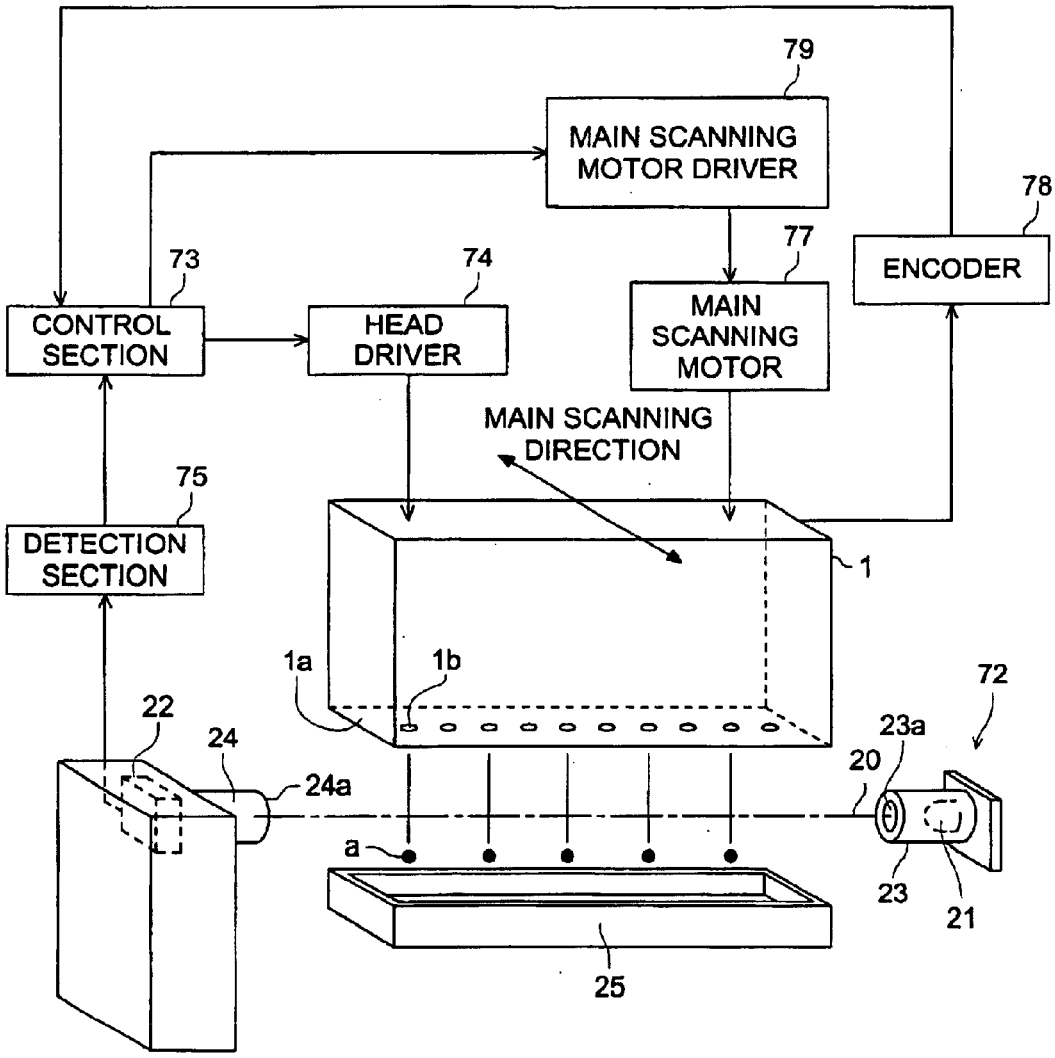
FIG. 19 is a schematic view of the main components in the ink-jet recorder pertaining to the present invention.

In the above description, the moving velocities of ink particles are detected by measuring the time required from the rise of the emission-starting signal applied to the ink-jetting head, to the detection of the velocities by the velocity detection means 72. The detection process can also be configured as shown in FIG. 17. Namely, velocity detection means 2A is arranged by two light-emitting elements 21*a* and 21*b* and two light-receiving elements 22*a* and 22*b* laid out at a predetermined spacing in the direction where ink particles "a" are emitted. Then the moving velocities of ink particles can be detected by measuring the time required for ink particles "a" to pass through the space between the two optical axes 20*a* and 20*b* formed by the light-emitting elements 21*a* and 21*b* and the light-receiving elements 22*a* and 22*b*, respectively.

The following describes a third embodiment of the present invention. The same components and circuit sections as those used in the second embodiment will be assigned with the same numerals of reference, and will not be described to avoid duplication. The emission of ink particles "a" is controlled when the driving of the head driver 74 of the ink-jetting head 1 is controlled by controlling section 73. Further, when the main-scanning motor driver 79 is controlled by controlling section 73, the main-scanning motor 77 is driven to allow the ink-jetting head 1 to be moved in the main-scanning direction. The positions that the ink-jetting head 1 takes when moving in the main-scanning direction are sequentially detected by an encoder 78.

According to the present invention, the ink-jetting head 1 during velocity detection of ink particles "a" moves in the main-scanning direction without stopping at the position where velocity is detected by the velocity detection means 72, i.e. above the optical path 20 of the detection light emitted from the light-emitting element 21. A prescribed driving voltage is applied when the drive of the head driver 74 is controlled by controlling section 73 at timed intervals when a bank of nozzles traverses the optical path 20 of the detection light during the movement of the ink-jetting head 1 in the main-scanning direction. Then ink particles "a" are emitted. The emission of ink particles "a" from the ink-jetting head 1 at this time is controlled so that they are emitted from the predetermined one or more of all nozzles 1*b*, 1*b*, - - - at the same timed intervals, not from all these nozzles.

When ink particles "a" emitted from a predetermined one or more of all nozzles 1*b*, 1, - - - of the ink-jetting head 1 traverse the optical path 20 during the movement of the ink-jetting head 1 in the main-scanning direction, the shadows of the particles are captured by the light-receiving element 22, and is sent to a detection section 75 as the detection signal of the light-receiving element 22 that denotes the change in the amount of light.

The number of ink-jetting heads is not restricted to one. As shown in FIG. 15, a plurality of independent ink-jetting heads for each color of ink can also be mounted on one carriage (not illustrated), and can be as an integrated unit in the main-scanning direction. FIG. 15 shows an example of four ink-jetting heads 111, 112, 113, and 114 corresponding to four colors Y, M, C, and K, respectively.

Figure 20:
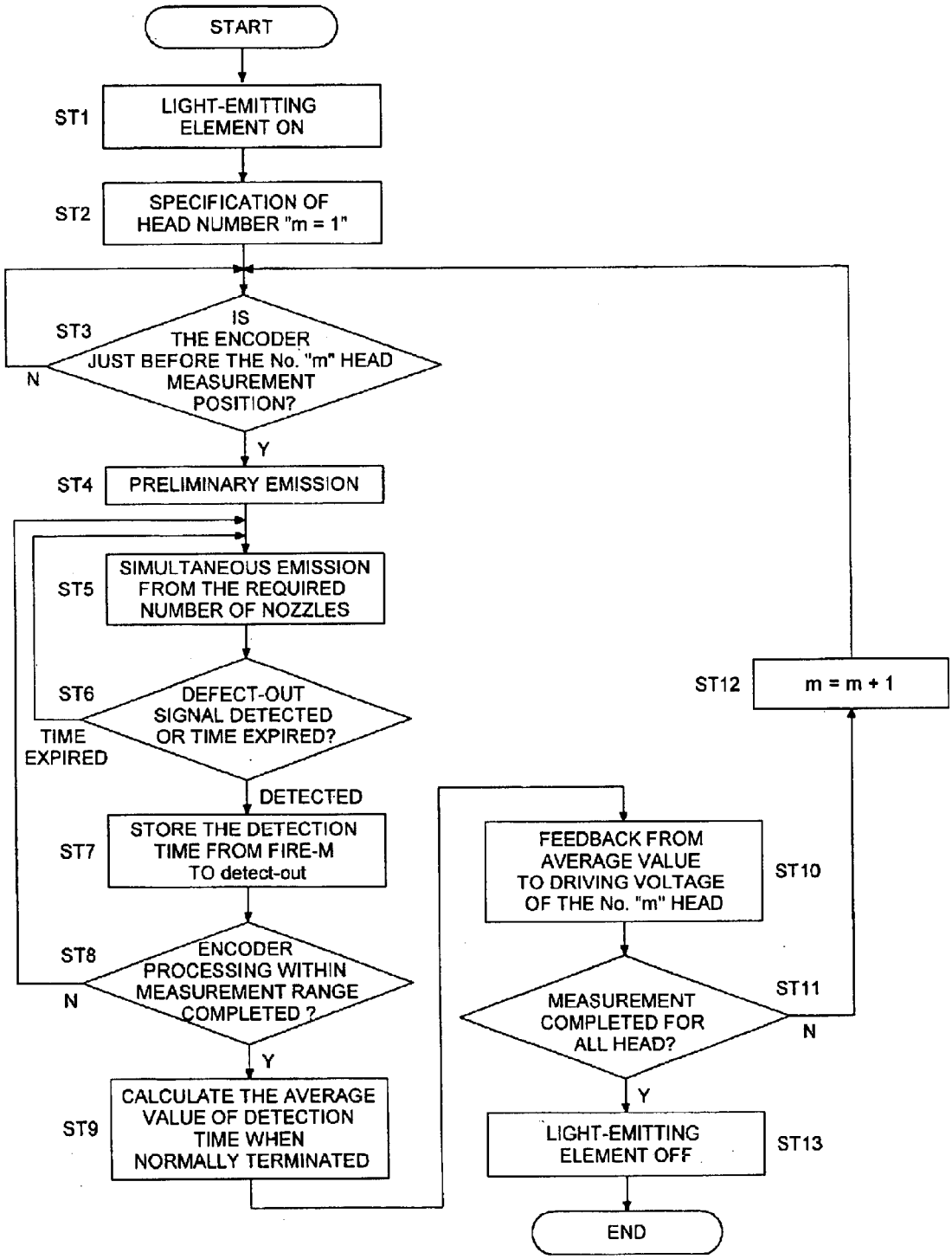
FIG. 20 is a control flow diagram showing the detection operation of velocity detection means.

The following describes the velocity detection of ink particles "a" in the third embodiment of the ink-jet recorder with reference to drawings. The flowchart of FIG. 20 will be used to describe the case where a plurality of ink-jetting heads 111, 112, - - - are provided as shown in FIG. 15.

The controlling section 73 controls the main-scanning motor driver 79, which drives the main-scanning motor 77 to move the carriage equipped with a plurality of ink-jetting heads at 100–200 mm/sec in the main-scanning direction. The positions of the ink-jetting heads in the main-scanning direction in this case are detected by an encoder 78. In this embodiment, the encoder 78 consists of a 180-dpi linear encoder, and the velocity of the carriage is about 140 mm/sec. When the movement of each ink-jetting head is started, the light-emitting element 21 is turned on sufficiently earlier than when the nozzle of the first ink-jetting head out of ink-jetting heads, 111, 112, - - - (hereinafter referred to as No. 1 head) traverses the optical path 20 of the detection light, and the velocity detection means 72 is activated to operate (ST1).

Velocity of ink particles "a" is detected from the No. 1 head, i.e. the first ink-jetting head located in the direction of movement for main scanning. In step ST2, controlling section 73 specifies that the first ink-jetting head to undergo velocity detection should be the No. 1 head of the ink-jetting heads. In step ST3, controlling section 73 monitors via the encoder 78 whether or not the bank of nozzles of the No. 1 head is positioned above the ink receiving pan 25 for receiving ink particles "a" and whether or not they have moved sufficiently close to the front of the optical path 20 of the detection light of the velocity detection means 72. When the bank of nozzles of the No. 1 head is positioned above the ink receiving pan 25 and have moved sufficiently close to the front of the optical path 20 (A in FIG. 21), the head driver 74 is driven to generate a FIRE-M signal as an emission starting signal (see FIG. 11). To ensure subsequent normal emission of ink particles "a", ink particles "a" are continuously emitted from all nozzles of the No. 1 head to undergo velocity detection in step ST4. During this process, ink-jetting head 1 continues to move in the main-scanning direction.

Figure 21:
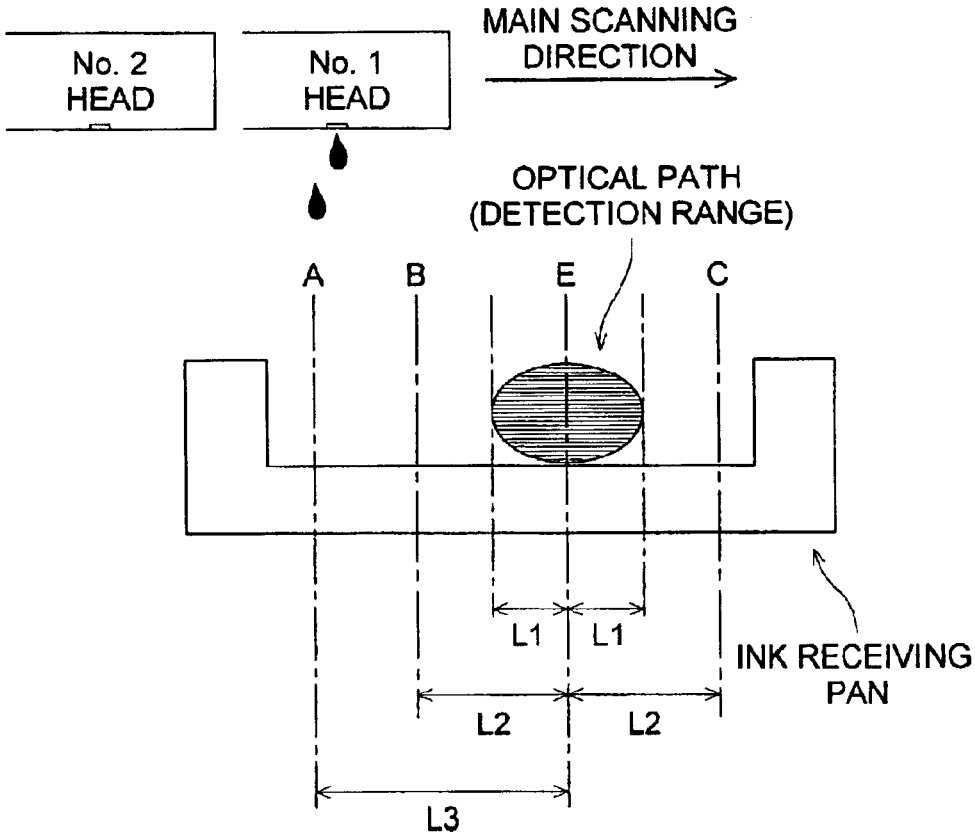
FIG. 21 is a diagram explaining the relationship between ink-jetting heads and an ink-receiving pan.

The No. 1 head further continues to move towards the optical path 20 of the velocity detection means 72, and reaches a position slightly before the optical path 20 (B in FIG. 21). When this is detected by encoder 78, the controlling section 73 allows each ink particle "a" to be emitted at the same timed intervals from the prescribed nozzles of all those of the No. 1 head (for example, every two nozzles in this case) in step ST5. If each particle is emitted from a predetermined multiple nozzle at the same timed intervals in this way, multiple ink particles "a" emitted at the same timed intervals can be regarded as one cluster of mutually overlapping ink particles "a" when observed from a direction parallel to the bank of nozzles and orthogonal to the direction of the ink particles "a" being emitted (i.e. along the optical path of detection light). This enhances the detection output level of the velocity detection means 72 and ensures highly accurate detection although the emission of very small ink particles "a" is detected. Furthermore, even if there is a very small variation in the moving velocity of ink particles "a" according to each nozzle of the ink-jetting head, these particles are captured as a cluster of ink particles, so an approximately averaged moving velocity can be detected for each ink-jetting head.

Figure 10:
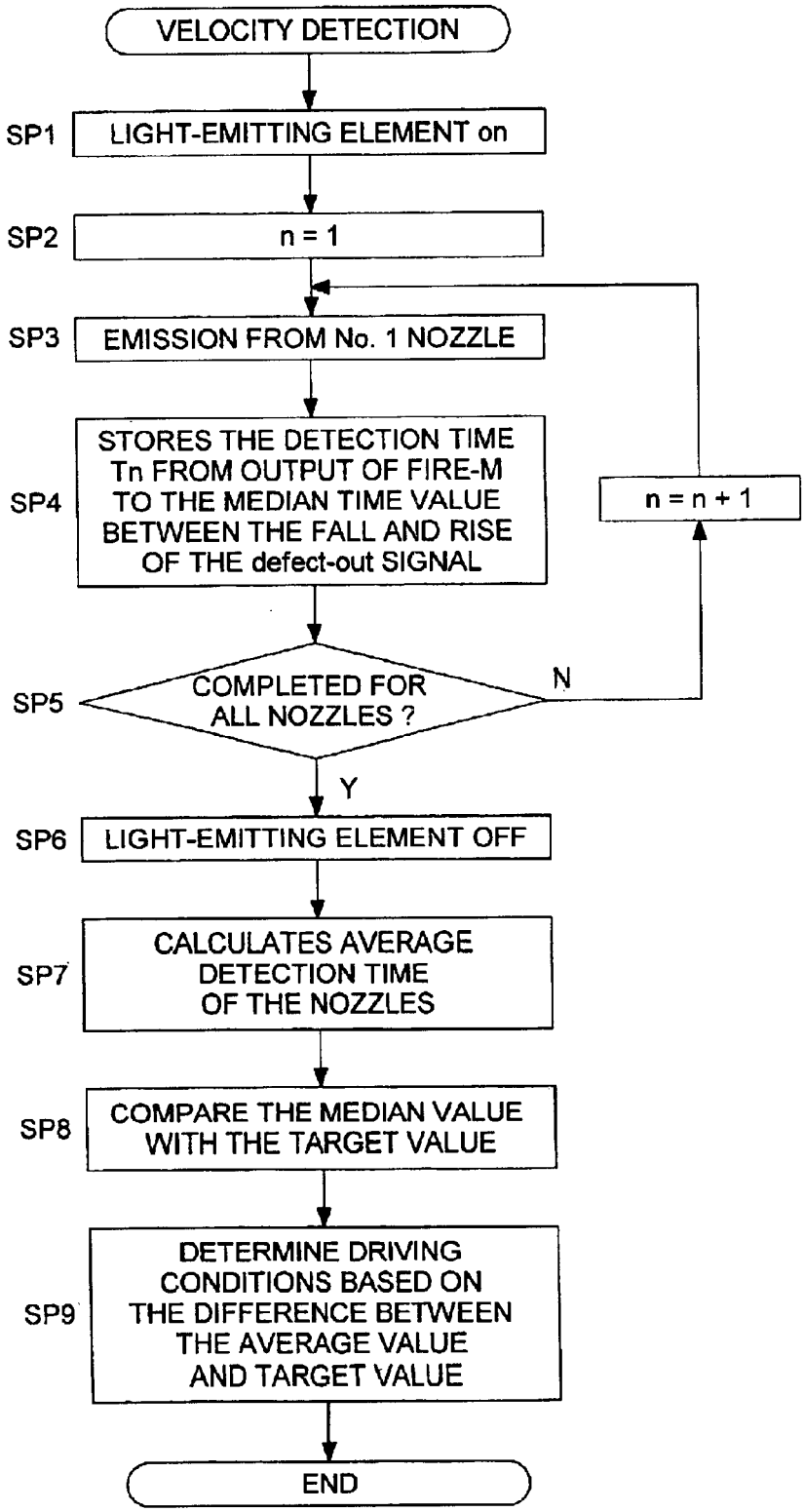
FIG. 10 is a control flow diagram showing the detection operation of the velocity detection means.

When emitted ink particles "a" have passed through the optical path 20 of the velocity detection means 72, detection light of light-receiving element 22 is partly intercepted, and the amount-of-light signal received temporarily decreases in level, with the result that detection signal is picked up and is sent to the detection section 75 shown in FIG. 10. As shown in FIG. 11, the detection section 75 uses the current amplifier 751 to amplify the amount-of-light signal received by the light-receiving element 22. Then the changed components of this signal are amplified by means of the AC amplifier 751 to get the signal for use in comparison with the reference signal. A comparator 753 compares this signal with the reference signal created via a low-pass filter 754. Changes of signal level exceeding the reference signal level are detected by the comparator 753. More specifically, when the ink particles "a" for velocity detection are emitted from the No. 1 nozzle and traverses the optical path 20 of the detection light, changes in signal component level exceeding the reference signal level are detected by the comparator 753, and the defect-out signal starts falling. Controlling section 73 determines if this defect-out signal sent from detection section 75 is present or not (Step ST6).

Figure 22:
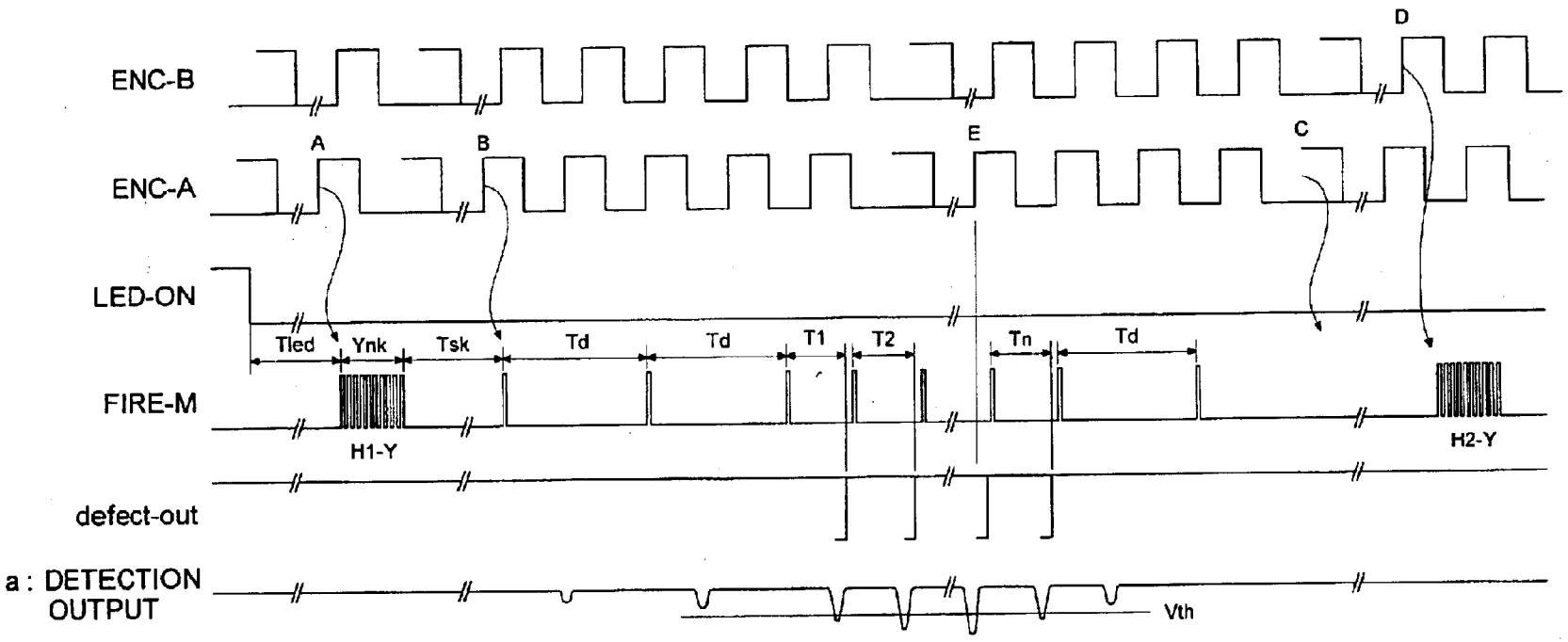
FIG. 22 is a timing chart of an emission starting signal and detection signal.

FIG. 22 is a timing chart representing the relationship between the timing of ink particle emission and the output of detection signal. As can be seen from this figure, when ink particles "a" are emitted from the neighborhood of position B shown in FIG. 21, this position is still away from the detection light path 20 of the velocity detection means 72. So the output detected by the light-receiving element 22 is still low without reaching the level (Vth) sufficient for detection, and a defect-out signal is not sent from detection section 75. The controlling section 73 detects the elapse of a predetermined time-out time (Td) subsequent to emission of ink particles "a", i.e. the time estimated to be sufficient for the ink particles "a" to traverse the optical path 20 of the detection light subsequent to emission of ink particles "a". After the lapse of time-out time (Td), each ink particle "a" is emitted again from the same nozzle at the same timed intervals. This sequence is repeated until the bank of nozzles the No. 1 head comes close to the optical path 20 of the detection light in step ST5 and a defect-out signal has been sent from detection section 75 (ST6). The ENC-A and ENC-B signals in FIG. 22 are output from encoder 78.

When emission of ink particles "a" is repeated and the No. 1 head continues to move in the main-scanning direction, the bank of nozzles comes closer to the optical path 20 of the detection light. Then the output level detected by the light-receiving element 22 gradually increases until a defect-out signal is sent from detection section 75, as shown in FIG. 22. When this defect-out signal has been output, the controlling section 73 measures the time (T1) from the start of emission of the ink particles "a" (FIRE-M) to the detection of the defect-out signal sent from the detector 75. To put it more specifically, the time period from the time "t1" when the emission starting signal (FIRE-M) was sent to the No. 1 head, to the median value "tn" between rise "tf" of the defect-out signal and fall "tb" is measured and stored into memory, as shown in FIG. 13 (ST7). Since the distance from the head surface 1*a* of the ink-jetting head 1 to the optical path 20 of the detection light is constant, the detection time T1 can be regarded as equivalent to the moving velocity of the ink particles "a". After that, the ink-jetting head continues to move in the main-scanning direction without stopping. During this process, controlling section 73 immediately repeats emission of ink particles "a" for the No. 1 head in the same manner. While the bank of nozzles of the No. 1 remains positioned above the optical path 20 of the detection light, controlling section 73 continues to measure T2, T3, and so on up to Tn.

As the further movement of the No. 1 head in the main-scanning direction causes the nozzle line to pass through the center (E in FIG. 21) of the optical path 20 of the detection light and to move away therefrom, the level of ink particle "a" detection signal detected by the light-receiving element 22 gradually decreases, until the No. 1 head reaches the position (C in FIG. 21) where detection signal is not output even when ink particles "a" have been emitted and the time-out interval has elapsed. In accordance with the detection output level of the encoder 78, the controlling section 73 determines whether or not the No. 1 head has reached position C. If the position is not yet reached, the aforementioned emission is repeated. When arrival to position C has been detected, emission of ink particles "a" from the No. 1 head stops (ST8).

When the ink-jetting head is moving towards the ink receiving pan 25 at a velocity of V, the following conditions are met for positions A, B, and C in FIG. 21:

A: Above the ink receiving pan 25 and (L3−L2)/V>Tsk+Ynk hours

B: L3/V>Td hours (Or L2>L1)

C: (L2−L1)/V>Td hours (Or L2>L1)

where "Ynk" denotes the time for preliminary emission, "Tsk" the time from the end of preliminary emission to the emission of ink particles for initial velocity detection, and "Td" time-out interval.

After the above velocity detection has terminated for the No. 1 head, the controlling section 73 calculates the average value of the moving velocities of the ink particles "a" for the No. 1 head, in accordance with the detection time data (T1 to Tn) of the ink particles "a" emitted from the No. 1 head obtained in the aforementioned manner, i.e. moving velocity detection value (ST9).

Detection values are not always suitable for the calculation of the above average value. For example, less reliable detection values obtained at positions away from the optical path 20 of the detection light such as with the first last detection values may be included in the data used to calculate the average value. Alternatively, the moving velocities detected during multiple emission operations may vary for some reason, and may result in variations in detection values. Calculations of the average value is not limited to those made directly using the detection values obtained in the process of multiple emission operations. It is preferable that the average value be calculated by removing the first and last detection values in multiple emission operations or the maximum and minimum detection values characterized by marked differences. This method allows moving velocities be detected with higher reliability.

In the manner described above, the moving velocities of ink particles "a" for the No. 1 head are detected, and their average value is calculated. After that, the controlling section 73 compares the aforementioned average detection value with the target value for the moving velocities of ink particles "a" stored in the controlling section 73. This target value is an ideal value denoting the moving velocity (=moving time) at which ink particles "a" emitted from the ink-jetting head during movement in the main-scanning direction hit the appropriate position of the recording medium. It is predetermined based on the main-scanning velocity of the ink-jetting head and the distance between the head surface 1*a* and the recording medium.

The controlling section 73 compares the average value with target value to get the difference of the average value from the target value. This difference denotes the deviation in the position hit by ink particles "a" emitted from the No. 1 head with respect to the appropriate position. To remove this difference, the controlling section 73 determines the driving conditions for the No. 1 head so that the average value matches the target value, and feeds back the driving conditions to the driving voltage (ST10). If the average value matches the target value, the position on the recording medium hit by ink particles emitted from each nozzle of the No. 1 head can be set approximately to the appropriate position.

These driving conditions can be determined from the data obtained by arithmetic processing based on the difference between the target value and the average value. They can also be determined using a look-up table based on the difference between them. In the former case, the driving conditions to be modified can be determined in details according to the difference between the target value and average value. This ensures more accurate image recording can be achieved. In the latter case, use of the look-up table allows quick determination of the driving conditions.

It is preferable that the above target value be changed according to the ambient conditions. More specifically, it is preferred to install a temperature detection means 76 such as a temperature sensor close to each nozzle of the ink-jetting head, or on an ink supply tube, an ink tank or the like to ensure that an environmental temperature can be appropriately detected. The connecting temperature detection means 76 is connected to the controlling section 73 as shown in FIG. 11, and the aforementioned target value is changed in response to the ambient temperature detected by the temperature detection means 76. Especially when ink viscosity depends on temperature characteristics, stability of ink movement is subjected to delicate changes depending on the moving velocities of ink particles. So deviations in the position hit by ink particles concentration control error can be corrected more accurately by changing the target value according to the ambient temperature. Modification data for this target value can be obtained from the computation by the controlling section 73 based on the detected temperature or by using a table where the relationship between the temperature and the target value is redefined.

Upon termination of the detection for the No. 1 head out of ink-jetting heads in the aforementioned manner, the controlling section 73 repeats the above-mentioned operation sequentially for the ink-jetting heads 1 (i.e. the No. 2 head, No. 3 head, up to the last head) that are moving in the main-scanning direction. Then it calculates average values for each head based on the detection values of the moving velocities in multiple emission operations, and conducts feedback to the driving voltage based on the difference from the average value (ST3 to ST12).

When the above-mentioned operation has been performed for all ink-jetting heads mounted on the carriage, controlling section 73 turns off the light-emitting element 21 (ST13) to complete the detection process.

In the present invention, there is no need of stopping the ink-jetting head above the optical path 20 of velocity detection light each time the moving velocity of ink particles "a" is to be detected. This increases the speed of detecting emission velocities at all nozzles for each ink-jetting head. For example, even when the ink-jetting head comprises a total of eight heads for creating four density levels of ink for each Y, M, C, and K, emission velocities can be detected for all heads in less than one to two seconds. This permits detection, for example, in image recording whenever the main-scanning operation of the ink-jetting head is performed several times, and (ensures delicate feedback control of the driving voltage, hence higher-quality image recording.

If the ink-jetting head 1 consists of multiple ink-jetting heads 111, 112, 113, and 114, it is preferable that the aforementioned target value be set for each ink-jetting head. When a plurality of ink-jetting heads 111, 112, - - - are provided, variations in installation accuracies of ink-jetting heads 111, 112, - - - may fail to ensure a constant distance between each head surface and recording medium P, and may produce deviations. As a result, when the moving velocities of the ink particles emitted from each ink-jetting head are the same, deviations occur for each color due to the difference in moving distance for each ink-jetting head. For these ink-jetting heads 111, 112, - - - , it is possible to solve the problem of deviations in the position hit by ink particles for each color by modifying the driving conditions as described above, using the target values predetermined for each of the ink-jetting heads 111, 112, - - - , and this step allows high-quality color images to be recorded.

In the above description, the ink-jetting head 1 is driven along the main-scanning direction with respect to the fixed velocity detection means 72 in the process of velocity detection. It is sufficient if the fixed velocity detection means 72 and the ink-jetting head 1 are movable in relative terms. So it is possible to make arrangements in such a way that the velocity detection means 72 moves along the main-scanning direction of the ink-jetting head 1 with respect to the fixed ink-jetting head 1, or the ink-jetting head 1 and the fixed velocity detection means 72 moves in the direction opposite to each other along the main-scanning direction.

Figure 23:
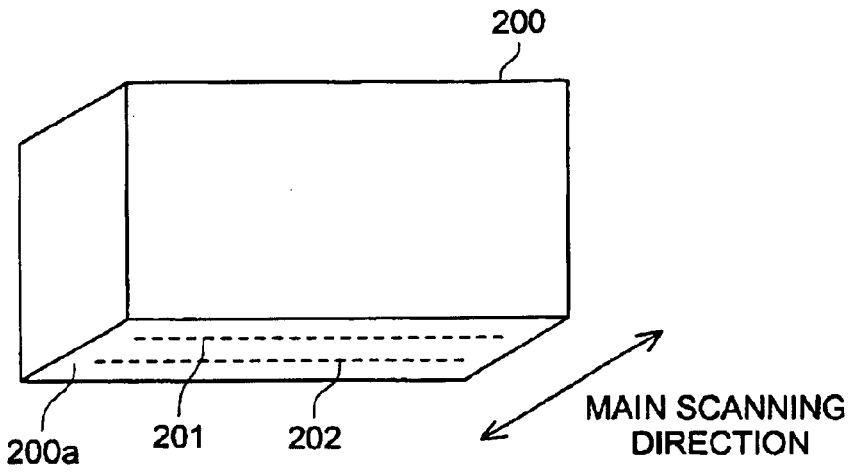
FIG. 23 is a perspective view showing another example of the ink-jetting head.

Furthermore, the ink-jetting head means can have multiple banks of nozzles 201 and 202 arranged in parallel along the main-scanning direction for the nozzle surface 200*a* of one ink-jetting head 200, as shown in FIG. 23. In this case, the aforementioned velocity detection should be performed for each bank of nozzles 201 and 202.

The above description applies to the case where an average value is calculated based on the velocity detection data of the velocity detection means 72 by repeating the emission of ink from a predetermined number of nozzles of the ink-jetting head at the same timed intervals for several times. This configuration is advantageous in that the detection accuracy of the velocity of ink particles "a" for the ink-jetting head is improved. However, if ink particles "a" are emitted from a plurality of nozzles at the same timed intervals, ink particles "a" of multiple shots emitted at the same timed intervals can be regarded as one cluster of overlapping ink particles "a", as viewed from a direction parallel to the bank of nozzles and orthogonal to the emission direction of the ink particles "a" (i.e. along the optical path 20 of the detection light). The detection value for each emission can be considered as representing an approximately average moving velocity. So detection efficiency can be improved by arithmetic processing as appropriate, for example, by taking the median value of detection values covering the detection range, without calculating an average value from a plurality of detection values.

Emission of ink particles "a" from a plurality of nozzles at the same timed intervals is intended to improve the detection output level of the velocity detection means 72 and to facilitate acquisition of an average moving velocity of ink emitted from the ink-jetting head. Emission can therefore be made only from a single nozzle, provided that the ink particles "a" have a sufficiently large size or a sufficiently high output level can be obtained using a low-noise circuit. Another reason for multiple emissions is to avoid the possibility of the emission position from deviating from the optical path 20 of the detection light. So one emission can be performed immediately when the bank of nozzles of the ink-jetting head has passed the optical path 20, provided, however, that the position of the optical path 20 is accurately detected and does not deviate from the emission position.

As described in the foregoing, according to the present invention, the following effects can be attained.

(1) According to the present invention, the values denoting the velocities of the ink particles emitted from each nozzle of the ink-jetting head is compared with the average nozzle value as the average value of the emission velocities of all nozzles for the ink-jetting head, thereby detecting the nozzle that deteriorates image printing accuracy.

(2) According to the present invention, if a nozzle is detected that deteriorates image printing accuracy, maintenance is provided on the ink-jetting head equipped with this nozzle. This makes it possible to achieve stable image printing accuracy, hence to provide an ink-jet printer capable of printing images characterized by more stable accuracy.

(3) According to the present invention, the average head value is calculated as the average value denoting the velocities of the ink particles emitted from the nozzles installed on all the ink-jetting heads, and compares this average head value with the average nozzle value for each ink-jetting head. If an ink-jetting head is detected that is significantly different from other ink-jetting heads in terms of ink particle emission velocity, the voltage applied to the detected ink-jetting head is corrected, thereby removing the factor that deteriorates image printing accuracy. This makes it possible to an ink-jet printer capable of printing images characterized by more stable accuracy.

(4) According to the present invention, permits easy creation of a velocity measuring means capable of detecting emission velocities with sufficient accuracy for comparison among multiple nozzles is permitted. This feature provides an ink-jet printer capable of printing images with stable accuracy at low costs.

(5) According to the present invention, the sensitivity of the ink particle detector for detecting ink particles can be improved. Accordingly, it becomes possible to stabilize the image printing accuracy of the ink-jet printer in a more reliable manner.

(6) The present invention reduces the causes for image deterioration and provides high-quality image recording, by detecting the moving velocities of ink particles emitted from the ink-jetting head and modifying the driving conditions based on the results.

(7) In the present invention in particular, it suffices to assign one set of modified driving conditions to one ink-jetting head. There is no need for complicated processing such as modifying of the driving conditions for each nozzle.

(8) The present invention allows removal of the causes for image deterioration due to the deviations in moving velocities of ink particles, even in the type of ink-jet recorder where only one driving signal is applied to one ink-jetting head, for example, in the type of ink-jetting head where the wall surfaces of a multitude of parallel ink chambers are formed of piezo-electric elements, and voltage is applied to each partition wall consisting of these piezo-electric elements, whereby ink particles are emitted through shear-deformation of this partition wall.

(9) The present invention provides an ink-jet recorder that detects the velocities of the ink particles during the movement of the ink-jetting head and measures the moving velocities of the ink particles emitted from the nozzles of the ink-jetting head, without stopping the ink-jetting head at a predetermined detection position as in the prior art. Based on measurement results, the aforementioned ink-jet recorder corrects the variations in the velocities of ink particles caused by environmental changes and rise of the ink-jetting head temperature in printing.

Disclosed embodiment can be varied by a skilled person without departing from the spirit and scope of the invention.

What is claimed is:

1. An ink-jet printer, comprising:

an ink-jetting head having a plurality of nozzles from which ink particles, being microscopic droplets of ink, are emitted;

a velocity detecting section to detect moving velocities of said ink particles, each of which is emitted from each of said plurality of nozzles, by measuring detection times at each of which each of said ink particles is detected;

a calculating section to calculate an average value of said detection times measured by said velocity detecting section; and a head-drive controlling section that compares said average value calculated by said calculating section with a target value established in advance, to change a driving condition for said ink-jetting head so that said average value coincides with said target value.

2. The ink-jet printer of claim 1, further comprising:

a target-value changing section to change said target value corresponding to an environmental condition around said ink-jet printer.

3. The ink-jet printer of claim 1, wherein said head-drive controlling section determines said driving condition, based on a difference value between said target value and said average value calculated by said calculating section.

4. The ink-jet printer of claim 1, wherein said head-drive controlling section determines said driving condition, by employing a look-up table based on a difference value between said target value and said average value calculated by said calculating section.

5. The ink-jet printer of claim 1, wherein, when said driving condition, determined by said head-drive controlling section, deviates from a stably-emitting condition of said ink particles, said head-drive controlling section establishes a specific value as said driving condition, said specific value being approximately equal to a marginal value for a stably-emitting action of said ink-jetting head.

6. The ink-jet printer of claim 1, further comprising:

a determining section to determine whether or not each of said detection times measured by said velocity detecting section exceeds a predetermined time value;

wherein, when said determining section determines that a detection time of a specific nozzle exceeds said predetermined time value, said calculating section excludes said detection time of said specific nozzle from a group of detection times objective for calculating said average value.

7. The ink-jet printer of claim 1, wherein said ink-jet printer comprises a plurality of ink-jetting heads, each of which corresponds to said ink-jetting head, and said target value is established for each of said plurality of ink-jetting heads.

8. An ink-jet printer, comprising:

an ink-jetting head having a plurality of nozzles from which ink particles, being microscopic droplets of ink, are emitted;

a velocity detecting section to detect moving velocities of said ink particles, each of which is emitted from each of said plurality of nozzles, by measuring detection times at each of which each of said ink particles is detected;

a moving device to move said ink-jetting head and/or said velocity detecting section relative to each other;

an emitting-action controlling section to control said ink-jetting head so that an action for emitting at least one of said ink particles from at least one of predetermined plural nozzles, included among all of said plurality of nozzles, is conducted at a timing when said plurality of nozzles cross a detectable region of said velocity detecting section in a relative moving process of said ink-jetting head and said velocity detecting section; and a head-drive controlling section that compares a detected value detected by said velocity detecting section with a target value established in advance, to change a driving condition for said ink-jetting head so that said detected value coincides with said target value.

9. The ink-jet printer of claim 8, wherein said emitting-action controlling section controls said ink-jetting head so that said action for emitting at least one of said ink particles from at least one of said predetermined plural nozzles, included among all of said plurality of nozzles, is repeated plural times at said timing when said plurality of nozzles cross said detectable region of said velocity detecting section; and wherein said detected value to be compared with said target value is an average value of plural detected values, each of which is detected every time of said plural times by said velocity detecting section.

10. The ink-jet printer of claim 8, further comprising:

a target-value changing section to change said target value corresponding to an environmental condition around said ink-jet printer.

11. The ink-jet printer of claim 8, wherein said head-drive controlling section determines said driving condition, based on a difference value between said target value and detected value detected by said velocity detecting section.

12. The ink-jet printer of claim 8, wherein said head-drive controlling section determines said driving condition, by employing a look-up table based on a difference value between said target value and said detected value detected by said velocity detecting section.

13. The ink-jet printer of claim 8, wherein, when said driving condition, determined by said head-drive controlling section, deviates from a stably-emitting condition of said ink particles, said head-drive controlling section establishes a specific value as said driving condition, said specific value being approximately equal to a marginal value for a stably-emitting action of said ink-jetting head.

14. The ink-jet printer of claim 8, wherein said ink-jet printer comprises a plurality of ink-jetting heads, each of which corresponds to said ink-jetting head, and said target value is established for each of said plurality of ink-jetting heads.

15. An ink-jet printer, which prints an image on a recording medium by emitting ink particles onto said recording medium, comprising:

an ink-jetting head to emit said ink particles from a plurality of nozzles onto said recording medium; and a velocity measuring section to measure moving velocity values of said ink particles emitted from said plurality of nozzles;

wherein a nozzle average value, being an average value of said moving velocity values measured by said velocity measuring section, is calculated, and a specific nozzle, which emits an ink particle at a moving velocity value being different from said nozzle average value by more than a predetermined value, is detected.

16. The ink-jet printer of claim 15, wherein, when said specific nozzle is detected, a maintenance operation for normalizing said specific nozzle is executed.

17. An ink-jet printer, which prints an image on a recording medium by emitting ink particles onto said recording medium, comprising:

a plurality of ink-jetting heads, each of which emits said ink particles from a plurality of nozzles onto said recording medium in response to drive-voltages applied to said plurality of nozzles; and a velocity measuring section to measure moving velocity values of said ink particles emitted from said plurality of nozzles;

wherein nozzle average values, each of which is an average value of said moving velocity measured for each of said plurality of ink-jetting heads by said velocity measuring section, are calculated, and then, a head average value, being an average value of said nozzle average values, is calculated; and wherein, with respect to a specific ink-jetting head, a nozzle average value of which is different from said head average value by more than a predetermined value, said drive-voltages, to be applied to said plurality of nozzles of said specific ink-jetting head, are compensated for.

18. The ink-jetting head of claim 17, further comprising:

a head-drive controlling section to control said plurality of ink-jetting heads; and a head-driving circuit to apply said drive-voltages to said plurality of nozzles, based on control signals transmitted from said head-drive controlling section;

wherein said velocity measuring section includes an ink-particle detecting device, disposed at a predetermined position being apart from said plurality of nozzles to detect passages of said ink particles, and a time-measuring circuit to measure time differences between output timings of said control signals and detected timings of said passages of said ink particles; and wherein said moving velocity values of said ink particles emitted from said plurality of nozzles are equivalent to said time differences.

19. An ink-jet printer, which prints an image on a recording medium by emitting ink particles onto said recording medium, comprising:

a plurality of ink-jetting heads, each of which emits said ink particles from a plurality of nozzles onto said recording medium;

a velocity measuring section to measure moving velocity values of said ink particles emitted from said plurality of nozzles;

a head-drive controlling section to control said plurality of ink-jetting heads; and a head-driving circuit to drive said plurality of ink-jetting heads so as to emit said ink particles from said plurality of nozzles, based on control signals transmitted from said head-drive controlling section;

wherein said velocity measuring section includes an ink-particle detecting device, disposed at a predetermined position being apart from said plurality of nozzles to detect passages of said ink particles, and a time-measuring circuit to measure time differences between output timings of said control signals and detected timings of said passages of said ink particles; and wherein said moving velocity values of said ink particles emitted from said plurality of nozzles are equivalent to said time differences.

20. The ink-jet printer of claim 19, wherein said ink-particle detecting device includes a wave-receiving section to receive a wave motion; and wherein said velocity measuring section detects a passage of an ink particle, based on either a local maximum or a local minimum of an output value of said wave-receiving section, which varies associating with an action of shading said wave motion to be arrived at said wave-receiving section.

* * * * *

UNITED STATES PATENT AND TRADEMARK OFFICE

CERTIFICATE OF CORRECTION

Figure 4:
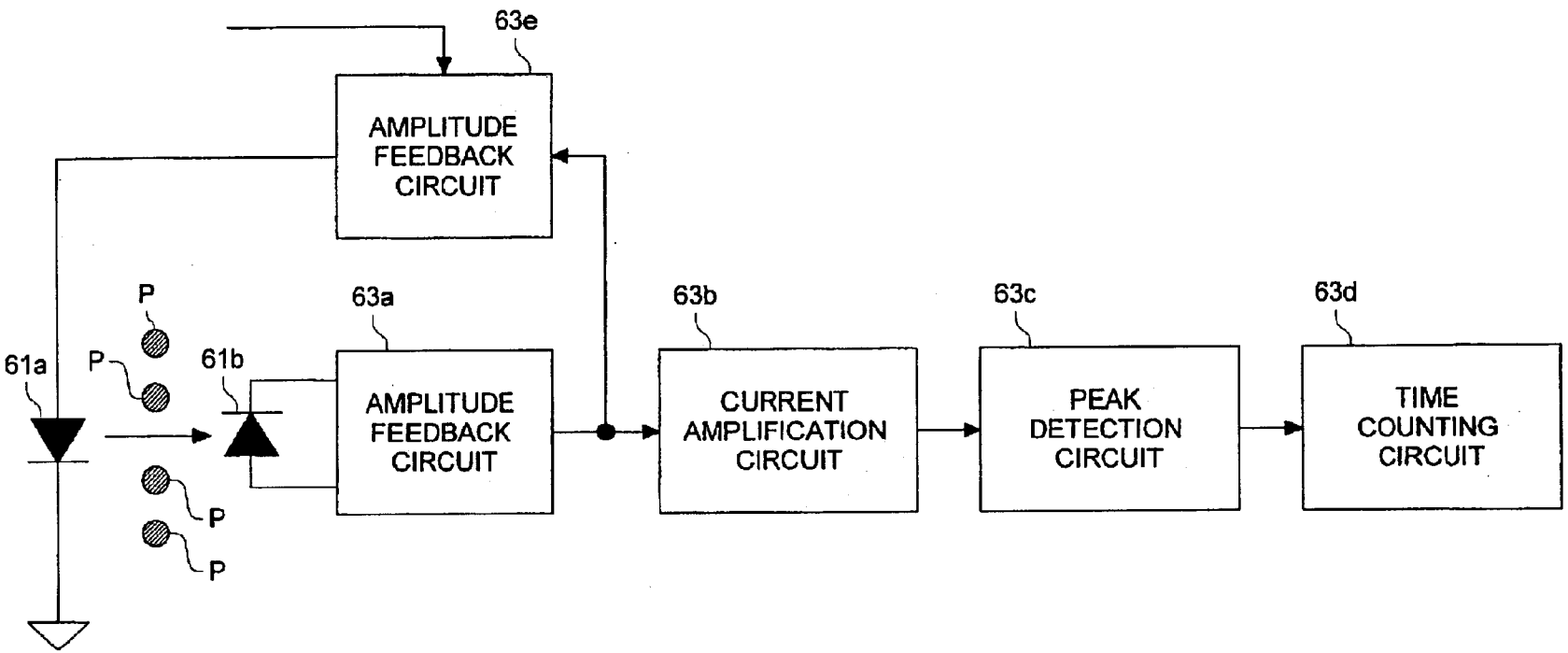
FIG. 4(*a*) and FIG. 4(*b*) are major component block diagrams showing the composition of the velocity measuring means applied to the ink-jet printer.

PATENT NO. : 6,843,548 B2
DATED : January 18, 2005
INVENTOR(S) : Hiroaki Akakawa It is certified that error appears in the above-identified patent and that said Letters Patent is hereby corrected as shown below:

Column 10,
Lines 16-17, change "FIG. 4(a) and 4(b) are major component block diagrams" to -- FIG. 4 is a major component block diagram --; and
Line 21, change "flow hart" to -- flow chart --.

Signed and Sealed this

Twenty-fourth Day of May, 2005

JON W. DUDAS
*Director of the United States Patent and Trademark Office*